US009230496B2

(12) United States Patent
Gyouten et al.

(10) Patent No.: US 9,230,496 B2
(45) Date of Patent: Jan. 5, 2016

(54) DISPLAY DEVICE AND METHOD OF DRIVING THE SAME

(75) Inventors: Seijirou Gyouten, Osaka (JP); Makoto Yokoyama, Osaka (JP); Takahiro Yamaguchi, Osaka (JP); Shige Furuta, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 210 days.

(21) Appl. No.: 13/981,219

(22) PCT Filed: Jan. 23, 2012

(86) PCT No.: PCT/JP2012/051318

§ 371 (c)(1),
(2), (4) Date: Jul. 23, 2013

(87) PCT Pub. No.: WO2012/102229

PCT Pub. Date: Aug. 2, 2012

(65) Prior Publication Data

US 2013/0300722 A1 Nov. 14, 2013

(30) Foreign Application Priority Data

Jan. 24, 2011 (JP) ..... 2011-011710

(51) Int. Cl.
*G09G 5/00* (2006.01)
*G09G 3/36* (2006.01)

(52) U.S. Cl.
CPC ..... *G09G 3/3648* (2013.01); *G09G 3/3611* (2013.01); *G09G 3/3685* (2013.01); *G09G 2310/0297* (2013.01)

(58) Field of Classification Search
CPC . G09G 3/3275; G09G 3/3648; G09G 3/3677; G09G 3/3688; G09G 3/3225; G09G 3/3611; G09G 3/3585; G09G 2300/08; G09G 2310/0272; G09G 2310/0297
See application file for complete search history.

(56) References Cited

U.S. PATENT DOCUMENTS

2004/0179014 A1* 9/2004 Nakano et al. ..... 345/501
2004/0227710 A1 11/2004 Shimizu et al.

(Continued)

FOREIGN PATENT DOCUMENTS

JP 2004-271729 A 9/2004
JP 2006-221191 A 8/2006

(Continued)

OTHER PUBLICATIONS

International Search Report and Written Opinion corresponding to PCT/JP2012/051318, dated Jan. 23, 2012.

*Primary Examiner* — Lixi C Simpson
(74) *Attorney, Agent, or Firm* — Hauptman Ham, LLP

(57) ABSTRACT

This display device has a demultiplexer (501) formed on a liquid crystal panel, the demultiplexer including three switching elements $SW_1$ to $SW_3$ for time-division drive, which are connected to video signal lines $SL_1$ to $SL_3$. Here, the number of switching control signal lines for transmitting switching control signals $GS_1$ to $GS_6$ to be provided to switching elements coupled to the video signal lines is six, which is twice the number of time divisions, and switching control signals (e.g., $GS_1$ and $GS_4$) with the same timing are individually transmitted by two switching control signal lines, so that the number of switching elements to be coupled to the switching control signal lines as loads can be halved, resulting in reduced waveform rounding of the control signals.

18 Claims, 12 Drawing Sheets

(56) References Cited

U.S. PATENT DOCUMENTS

| | | | | |
|---|---|---|---|---|
| 2006/0007768 | A1* | 1/2006 | Kim | 365/205 |
| 2006/0232541 | A1* | 10/2006 | Kudo et al. | 345/98 |
| 2007/0236435 | A1* | 10/2007 | Miyazaki et al. | 345/87 |
| 2007/0268233 | A1 | 11/2007 | Hashimoto et al. | |
| 2008/0043012 | A1* | 2/2008 | Shirai | 345/215 |
| 2009/0146938 | A1* | 6/2009 | Takada et al. | 345/98 |
| 2010/0013864 | A1* | 1/2010 | Oelhafen et al. | 345/690 |
| 2010/0060806 | A1* | 3/2010 | Ina et al. | 348/791 |

FOREIGN PATENT DOCUMENTS

| | | | |
|---|---|---|---|
| JP | 2007-310234 | A | 11/2007 |
| JP | 2010-054903 | A | 3/2010 |

* cited by examiner

DISPLAY DEVICE AND METHOD OF DRIVING THE SAME

RELATED APPLICATIONS

The present application is a National Phase of International Application Number PCT/JP2012/051318, filed Jan. 23, 2012, and which is based upon and claims the benefit of priority from Japanese Patent Application No. 2011-011710, filed on Jan. 24, 2011.

TECHNICAL FIELD

The present invention relates to active-matrix display devices, more specifically to a display device employing a mode of driving video signal lines in a time-division manner, in which a driver circuit sequentially outputs video signals to a number of video signal lines, which transmit the video signals to a plurality of pixel forming portions for forming an image to be displayed, via switching elements, and the invention also relates to a drive method therefor.

BACKGROUND ART

In a general active-matrix liquid crystal display device including a liquid crystal panel with a display area, the liquid crystal panel consists of two substrates with a liquid crystal layer provided therebetween, one of the two substrates has a plurality of data lines, which serve as video signal lines, and a plurality of gate lines, which serve as scanning signal lines, arranged in a matrix, and the substrate also has a plurality of pixel forming portions arranged in a matrix so as to correspond to intersections of the data lines and the gate lines. The pixel forming portions are components for providing image display on the liquid crystal panel, and each of them includes a TFT (thin-film transistor), which is a switching element with a gate terminal connected to the gate line and a source terminal connected to the data line, and also includes a pixel electrode and an auxiliary capacitor connected to a drain terminal of the TFT. The other of the two substrates has a common electrode provided thereon, and a voltage to be applied to the liquid crystal has a value corresponding to a difference between a voltage supplied to the common electrode and a voltage supplied to the pixel electrode, so that display is provided in accordance with the voltage value.

Such an active-matrix liquid crystal display device has a data driver for driving the data lines of the liquid crystal panel, a gate driver for driving the gate lines, a common electrode driver circuit for driving the common electrode, and a display control circuit for controlling the data driver, the gate driver, and the common electrode driver circuit. Note that the gate driver, the data driver, and other circuits can be formed on the glass substrate by, for example, an LTPS process using low-temperature polysilicon (abbreviated below as "LIPS"), or they can be mounted on a glass substrate by COG (chip-on-glass) technology, or provided outside a glass substrate, as a semiconductor device with all or part of the above circuits being integrated on a semiconductor substrate (such a device will be simply referred to below as an "IC").

Here, with recent advancement in high display image resolution on display devices, the number of signal lines per unit length has increased significantly, for example, in display devices, such as active-matrix liquid crystal display devices, which require signal lines (data lines or gate lines) whose number corresponds to the resolution of images to be displayed. As a result, the driver circuit that applies signals to the signal lines has an extremely narrow pitch of connections (referred to below as "connection pitch") of output terminals of the driver circuit and the signal lines of the display panel. Such a tendency toward a narrow connection pitch as accompanied by advancement in high display image resolution is particularly noticeable at connections of video signal lines and a driver circuit therefor (data driver) in a color display device, such as a color liquid crystal display device, in which a unit of display consists of three adjacent pixels, R (red), G (green), and B (blue).

In a conventional liquid crystal display device proposed to overcome such an issue, the video signal lines are divided into groups of two or more (e.g., three video signal lines corresponding to three adjacent pixels, R, G, and B), and one output terminal of the video signal line driver circuit is assigned per group of video signal lines such that video signals are applied through all output terminals to the groups of video signal lines in a time-division manner during one horizontal scanning period for image display.

In the liquid crystal display device employing a mode of driving video signal lines in a time-division manner as described above, the time period for which to charge each video signal line is shortened in accordance with the number of video signal lines in each group, i.e., the number of time divisions by change-over switches, and where the number of time divisions is d, the time period for which to charge each video signal line is 1/d or less than 1/d of that for a regular liquid crystal display device, which does not employ the mode of driving video signal lines in a time-division manner. However, by forming change-over switches with the number of time divisions d on a substrate of a liquid crystal panel, the connection pitch of output terminals of a video signal line driver circuit and the video signal lines can be d-fold of that in a regular liquid crystal display device. Moreover, with such a configuration, the number of chips can be reduced where a video signal line driver circuit consisting of a plurality of integrated circuit chips (IC chips) is used for driving one liquid crystal panel. The advantage of such a video-signal-line time-division drive mode is widely known, and therefore, the video signal lines are often divided into groups of three that transmit video signals to three adjacent pixels, R (red), G (green), and B (blue).

In this manner, in the liquid crystal display device employing the video-signal-line time-division drive mode, the time period for which to charge each video signal line is 1/d or less than 1/d of that for a regular liquid crystal display device. Therefore, control signals (control pulses) to be provided to the change-over switches preferably have as little waveform rounding as possible, so that the change-over switches are reliably kept on for a time period required for charging. As waveform rounding increases, more time is taken until an on-state potential for turning on the change-over switch is reached, resulting in a shorter period of time for which the change-over switch is kept on.

In this regard, Japanese Laid-Open Patent Publication No. 2004-271729 discloses a display device in which change-over switches are arranged with respect to control signal lines for transmitting control signals, such that distances between adjacent change-over switches and their respective control signal input terminals are approximately equal, whereby the control signals provided to the change-over switches have approximately the same degree of waveform rounding, and further, the control signals are inputted to the control signal lines from both ends, thereby reducing waveform rounding of the control signals. Such a configuration reduces uneven display due to waveform rounding.

CITATION LIST

Patent Document

Patent Document 1: Japanese Laid-Open Patent Publication No. 2004-271729

SUMMARY OF THE INVENTION

Problems to be Solved by the Invention

However, in the case where the configuration described in Japanese Laid-Open Patent Publication No. 2004-271729 is applied to a high-resolution display device with a particularly large number of video signal lines, control signals provided to change-over switches provided distantly from input terminals have increased waveform rounding. Specifically, an increase in number of change-over switches coupled to control signal lines between the input terminals and these (distantly provided) change-over switches results in a larger load, hence increased waveform rounding. Therefore, even with the configuration in which control signals are inputted to control signal lines from both ends, waveform rounding of control signals might not be reduced to a significantly lesser degree.

Furthermore, for the display panel that is used for a device which needs to be compact, such as a handheld terminal, an area (called a frame area) that is outside a display screen and does not contribute to display is required to be as small as possible. Accordingly, to reduce the frame area, it is necessary in some cases to adopt a configuration in which control signals are inputted to control signal lines from one side, and in such a case, waveform rounding of the control signals cannot be reduced to a significantly lesser degree.

Therefore, an objective of the present invention is to provide a display device employing the video-signal-line time-division drive mode as above, and a drive method therefor, in which waveform rounding of control signals that are provided to switches coupled to video signal lines is reduced.

Solution to the Problems

A first aspect of the present invention is directed to an active-matrix display device with a plurality of pixel forming portions for forming an image to be displayed, a plurality of video signal lines for transmitting video signals representing the image to be displayed, a plurality of scanning signal lines crossing the video signal lines, and a plurality of control signal lines for transmitting control signals to control a plurality of switching elements provided so as to respectively correspond to the video signal lines, the pixel forming portions being arranged in a matrix in correspondence with respective intersections of the video signal lines and the scanning signal lines, the device comprising:

a scanning signal line driver circuit for selectively driving the scanning signal lines;

a video-signal-line time-division drive portion for driving the video signal lines by sequentially applying image signal inputted to represent the image to be displayed, to the video signal lines via the switching elements in a time-division manner within a predetermined period; and a display control circuit for providing the control signals to the switching elements via the control signal lines, thereby controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive portion includes:

a video signal output circuit with a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, and the control signal lines are divided into sets whose number is equivalent to the number of time divisions, each set having a plurality of control signal lines for transmitting a plurality of control signals to control switching elements that are to be turned on within a unit period of the time division.

In a second aspect of the present invention, based on the first aspect of the invention, there are further included buffer circuits respectively coupled to the control signal lines, for each set of control signal lines, the display control circuit has one second output terminal for outputting the control signal, and the buffer circuits receive the control signals outputted from the second output terminals corresponding to the sets of control signal lines, and provide the control signals to the control signal lines coupled thereto.

In a third aspect of the present invention, based on the second aspect of the invention, for each set of control signal lines, the number of buffer circuits provided between the control signal line coupled thereto and the second output terminal corresponding to that set of control signal lines varies among the same set of control signal lines so that control signals transmitted by the coupled control signal lines have different phases among the same set of control signal lines.

In a fourth aspect of the present invention, based on the second aspect of the invention, the display control circuit applies the control signals to the control signal lines only from one end, and the buffer circuits are coupled to that end.

In a fifth aspect of the present invention, based on the second aspect of the invention, the display control circuit applies the control signals to the control signal lines from both ends, and the buffer circuits are coupled to either of the ends.

In a sixth aspect of the present invention, based on the second aspect of the invention, the display control circuit applies the control signals to the control signal lines from an input point other than both ends, and the buffer circuits are coupled to the input point.

In a seventh aspect of the present invention, based on the first aspect of the invention, there are further included a plurality of buffer circuits respectively coupled to the control signal lines, for each set of switching elements to be turned on within a unit period of the time division, the buffer circuits receive control signals from the control signal lines coupled thereto, and provide the control signals to switching elements respectively coupled to different first output terminals among the same set of switching elements.

In an eighth aspect of the present invention, based on the first aspect of the invention, the first output terminals of the video signal output circuit respectively correspond to video signal line groups into which the video signal lines are divided, each group consisting of adjacent video signal lines respectively coupled to a plurality of pixel forming portions that respectively display predetermined primary colors.

In a ninth aspect of the present invention, based on the first aspect of the invention, for each set of control signal lines, the display control circuit outputs control signals that rise and fall at different times from each other during the unit period.

In a tenth aspect of the present invention, based on the first aspect of the invention, there are further included delay circuits, each being coupled to one of the control signal lines, and the delay circuits are provided one or more for each set of control signal lines such that control signals transmitted by the set of control signal lines have different phases from each other during the unit period.

In an eleventh aspect of the present invention, based on the first aspect of the invention, the display control circuit applies the control signals to the control signal lines only from one end.

In a twelfth aspect of the present invention, based on the first aspect of the invention, the display control circuit applies the control signals to the control signal lines from both ends.

In a thirteenth aspect of the present invention, based on the first aspect of the invention, the display control circuit applies the control signals to the control signal lines from an input point other than both ends.

A fourteenth aspect of the present invention is directed to an active-matrix display device with a plurality of pixel forming portions for forming an image to be displayed, a plurality of video signal lines for transmitting video signals representing the image to be displayed, a plurality of scanning signal lines crossing the video signal lines, and a plurality of control signal lines for transmitting control signals to control a plurality of switching elements provided so as to respectively correspond to the video signal lines, the pixel forming portions being arranged in a matrix in correspondence with respective intersections of the video signal lines and the scanning signal lines, the device comprising:

a scanning signal line driver circuit for selectively driving the scanning signal lines;

a video-signal-line time-division drive portion for driving the video signal lines by sequentially applying image signal inputted to represent the image to be displayed, to the video signal lines via the switching elements in a time-division manner within a predetermined period;

a plurality of buffer circuits respectively coupled to the control signal lines; and a display control circuit for providing the control signals to the switching elements via the buffer circuits coupled to the control signal lines, thereby controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive portion includes:

a video signal output circuit with a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, the control signal lines are provided in a number equivalent to the number of time divisions, and for each set of switching elements to be turned on within a unit period of the time division, the buffer circuits receive control signal transmitted by the control signal line coupled thereto, and respectively output the control signals to control switching elements coupled within the same set.

In a fifteenth aspect of the present invention, based on the fourteenth aspect of the invention, for each set of switching elements, the number of buffer circuits provided between the control signal line coupled thereto and the coupled switching elements varies among the same set of switching elements so that control signals transmitted to the coupled switching elements have different phases among the same set of switching elements during the unit period.

A sixteenth aspect of the present invention is directed to a method for driving an active-matrix display device with a plurality of pixel forming portions for forming an image to be displayed, a plurality of video signal lines for transmitting video signals representing the image to be displayed, a plurality of scanning signal lines crossing the video signal lines, and a plurality of control signal lines for transmitting control signals to control a plurality of switching elements provided so as to respectively correspond to the video signal lines, the pixel forming portions being arranged in a matrix in correspondence with respective intersections of the video signal lines and the scanning signal lines, the method comprising:

a scanning signal line drive step of selectively driving the scanning signal lines;

a video-signal-line time-division drive step of driving the video signal lines by sequentially applying image signal inputted to represent the image to be displayed, to the video signal lines via the switching elements in a time-division manner within a predetermined period; and a display control step of providing the control signals to the switching elements via the control signal lines, thereby controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive step includes:

an output step by a video signal output circuit with a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a switching step by a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, and the control signal lines are divided into sets whose number is equivalent to the number of time divisions, each set consisting of a plurality of control signal lines for transmitting a plurality of control signals to control switching elements that are to be turned on within a unit period of the time division.

A seventeenth aspect of the present invention is directed to a method for driving an active-matrix display device with a plurality of pixel forming portions for forming an image to be displayed, a plurality of video signal lines for transmitting video signals representing the image to be displayed, a plurality of scanning signal lines crossing the video signal lines, and a plurality of control signal lines for transmitting control signals to control a plurality of switching elements provided so as to respectively correspond to the video signal lines, the pixel forming portions being arranged in a matrix in correspondence with respective intersections of the video signal lines and the scanning signal lines, the method comprising:

a scanning signal line drive step of selectively driving the scanning signal lines;

a video-signal-line time-division drive step of driving the video signal lines by sequentially applying image signal inputted to represent the image to be displayed, to the video signal lines via the switching elements in a time-division manner within a predetermined period;

a step of driving a plurality of buffer circuits respectively coupled to the control signal lines; and a display control step of providing the control signals to the switching elements via the buffer circuits coupled to the control signal lines, thereby controlling the switching elements so as to be kept on for a period required for providing video signals to pixel forming portions coupled to the scanning signal lines selected in the scanning signal line drive step, the video signals being transmitted by video signal lines corresponding to the pixel forming portions, wherein, the video-signal-line time-division drive step includes:

an output step by a video signal output circuit with a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a switching step by a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, the control signal lines are provided in a number equivalent to the number of time divisions, and for each set of switching elements to be turned on within a unit period of the time division, the buffer circuits receive control signal transmitted by the control signal line coupled thereto, and respectively output the control signals to control switching elements coupled within the same set.

Effect of the Invention

According to the first aspect of the present invention, the control signal lines are divided into sets whose number is equivalent to the number of time divisions, each set consisting of a plurality of control signal lines for transmitting a plurality of control signals to control switching elements that are to be turned on within a unit period of the time division, and therefore, when compared to the configuration provided with control signal lines whose number is equivalent to the number of time divisions, the number of switching elements coupled to the control signal lines can be reduced to a half or less (e.g., a half where each set consists of two control signal lines). Accordingly, waveform rounding of the control signals transmitted by the control signal lines can be reduced. As a result, an appropriate turn-on time can be ensured for each switching element, whereby display defects due to insufficient charge in the pixel forming portions can be inhibited or eliminated.

According to the second aspect of the present invention, the display control circuit has one output terminal for each set of control signal lines, resulting in a simplified configuration, and there is no increase in the number of lines from the display control circuit to the buffer circuits, leading to simplified wiring.

According to the third aspect of the present invention, for each set of control lines, the number of buffer circuits provided between the control signal line coupled thereto and the second output terminal corresponding to that set of control signal lines varies among the same set of control signal lines so that control signals transmitted by the coupled control signal lines have different phases among the same set of control signal lines, making it possible to reduce the maximum instantaneous current (inrush current) that occurs in the power source at the rise or fall of the control signals among the same set. Thus, power source noise can be suppressed, thereby inhibiting or eliminating malfunction (or undesirable operations or suchlike) of the display device due to power source noise.

According to the fourth aspect of the present invention, the buffer circuits are provided only between the display control circuit and one end of the control signal lines, so that only a portion of the frame area, which is close to the end of control signal lines, is used. Thus, the frame area of the display device can be reduced.

According to the fifth aspect of the present invention, the buffer circuits are provided at both ends of the control signal lines, and therefore, (if there is no other input point,) waveform rounding of the control signals is maximized at the center of the control signal lines. As a result, when compared to the case where the buffer circuits are provided only on one side, waveform rounding is reduced, and therefore, even in a high-resolution display panel with a number of video signal lines, an appropriate turn-on time can be ensured for each switching element. Thus, in such a case also, display defects due to insufficient charge in the pixel forming portions can be inhibited or eliminated.

According to the sixth aspect of the present invention, the buffer circuits are provided other than at both ends of the control signal lines, so that the distance of wiring from the outputs of the display control circuit to the buffer circuits can be minimized in accordance with the position of the display control circuit, curtailing an unnecessary wiring area. Moreover, in the case where the buffer circuits are provided near the center of the control signal lines, waveform rounding of the control signals is maximized at both ends of the control signal lines, and therefore, when compared to, for example, the case where the buffer circuits are provided only on one side, waveform rounding is reduced. Thus, even in a high-resolution display panel with a number of video signal lines, an appropriate turn-on time can be ensured for each switching element, and in such a case also, display defects due to insufficient charge in the pixel forming portions can be inhibited or eliminated.

According to the seventh aspect of the present invention, there are further provided a plurality of buffer circuits respectively coupled to the control signal lines such that the buffer circuits receive control signals from the control signal lines coupled thereto, and provide the control signals to a set of switching elements respectively coupled to different first output terminals, and therefore, the buffer circuits can reduce or eliminate the load on the control signal lines from the switching elements connected thereto. Thus, waveform rounding of the control signals transmitted by the control signal lines can be reduced, whereby display defects due to insufficient charge in the pixel forming portions can be inhibited or eliminated.

According to the eighth aspect of the present invention, the first output terminals of the video signal output circuit respectively correspond to video signal line groups into which the video signal lines are divided, each group consisting of adjacent video signal lines respectively coupled to a plurality of pixel forming portions that respectively display predetermined primary colors, and therefore, it is rendered possible to achieve a simplified drive configuration in which video signals are sequentially outputted from the first output terminals, with one primary color for each unit period of the time division.

According to the ninth aspect of the present invention, for each set of control signal lines, control signals that rise and fall at different times from each other during the unit period are outputted, making it possible to reduce the maximum instantaneous current (inrush current) that occurs in the power source at the rise or fall of the control signals among the same set. Thus, power source noise can be suppressed, whereby malfunction (or undesirable operations or suchlike) of the display device due to power source noise can be inhibited or eliminated.

According to the tenth aspect of the present invention, one or more delay circuits are provided for each set of control signal lines such that control signals transmitted by the set of control signal lines have different phases from each other during the unit period, and therefore, the control signals among the same set have a waveform phase difference at the time of rise or fall. Thus, it is possible to reduce the maximum instantaneous current (inrush current) in the power source, thereby inhibiting or eliminating malfunction or suchlike of the display device due to power source noise.

According to the eleventh aspect of the present invention, the control signals are applied to the control signal lines only from one end, and therefore, only a portion of the frame area, which is close to that end, is used as an area of wiring from the display control circuit. Thus, the frame area of the display device can be reduced.

According to the twelfth aspect of the present invention, (if there is no other input point,) waveform rounding of the signals is maximized at the center of the control signal lines, and therefore, when compared to the case where the buffer circuits are provided only on one side, waveform rounding is reduced. Thus, even in a high-resolution display panel with a number of video signal lines, an appropriate turn-on time can be ensured for each switching element, and therefore, in such a case also, display defects due to insufficient charge in the pixel forming portions can be inhibited or eliminated.

According to the thirteenth aspect of the present invention, (if there is no other input point,) waveform rounding of the signals is maximized at both ends of the control signal lines, and therefore, when compared to, for example, the case where the buffer circuits are provided only on one side, waveform rounding is reduced. Thus, even in a high-resolution display panel with a number of video signal lines, an appropriate turn-on time can be ensured for each switching element, and therefore, in such a case also, display defects due to insufficient charge in the pixel forming portions can be inhibited or eliminated.

According to the fourteenth aspect of the present invention, the control signal lines are provided in a number corresponding to the number of time divisions, the buffer circuits receive control signals transmitted by the control signal lines coupled thereto, and for each set of switching elements that are to be turned on within a unit period of the time division, the buffer circuits respectively output the control signals to control switching elements coupled within the same set, so that the buffer circuits can reduce or eliminate the load on the control signal lines from the switching elements connected thereto. Thus, waveform rounding of the control signals transmitted by the control signal lines can be reduced, whereby display defects due to insufficient charge in the pixel forming portions can be inhibited or eliminated.

According to the fifteenth aspect of the present invention, for each set of switching elements, the number of buffer circuits provided between the control signal line coupled thereto and the coupled switching elements varies among the same set of switching elements so that control signals transmitted to the coupled switching elements have different phases among the same set of switching elements during the unit period. As a result, it is possible to reduce the maximum instantaneous current (inrush current) that occurs in the power source at the rise or fall of the control signals among the same set. Thus, power source noise can be suppressed, whereby malfunction (or undesirable operations or suchlike) of the display device due to power source noise can be inhibited or eliminated.

The sixteenth aspect of the present invention makes it possible for a display device drive method to achieve a similar effect to that achieved by the first aspect of the invention.

The seventeenth aspect of the present invention makes it possible for a display device drive method to achieve a similar effect to that achieved by the fourteenth aspect of the invention.

MODES FOR CARRYING OUT THE INVENTION

Hereinafter, embodiments of the present invention will be described with reference to the drawings.

<1. First Embodiment>

<1.1 Overall Configuration and Operation of the Liquid Crystal Display Device>

Figure 1:
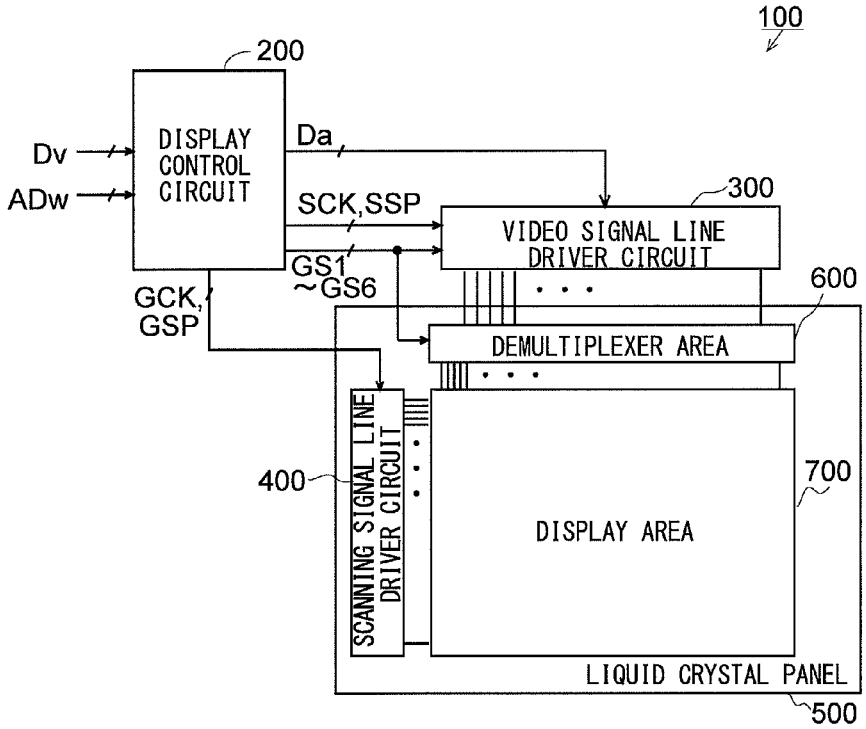
FIG. 1 is a block diagram illustrating the configuration of a liquid crystal display device according to a first embodiment of the present invention.

FIG. 1 is a block diagram illustrating the configuration of a liquid crystal display device according to a first embodiment of the present invention. The liquid crystal display device 100 includes a display control circuit 200, a video signal line driver circuit (also referred to as a "column-electrode driver circuit" or a "source driver") 300, and an active-matrix liquid crystal panel 500. The liquid crystal panel 500 has a scanning signal line driver circuit (also referred to as a "row-electrode driver circuit" or a "gate driver") 400 formed on a glass substrate by the aforementioned LTPS process, and also has a demultiplexer area 600 and a display area (pixel area) 700 as will be described below. Note that in the present embodiment, the scanning signal line driver circuit 400, along with other components, is formed on the glass substrate by the LTPS process, but a well-known process other than the LTPS process may be used. Moreover, circuits peripheral to the display area, including the scanning signal line driver circuit 400, may be ICs or suchlike outside the glass substrate.

The display area 700 of the liquid crystal panel 500 in the liquid crystal display device 100 includes a plurality of scanning signal lines (row electrodes), which respectively correspond to horizontal scanning lines in an image represented by image data Dv to be received from a CPU or suchlike of an external computer, a plurality of video signal lines (column electrodes), which cross each of the scanning signal lines, and a plurality of pixel forming portions, which are provided so as to respectively correspond to intersections of the scanning signal lines and the video signal lines. The configuration of each pixel forming portion is basically the same as in conventional active-matrix liquid crystal panels (details will be described later).

In the present embodiment, (narrow) image data that represents an image to be displayed in the display area 700 of the liquid crystal panel 500, and data for determining, for example, the timing of a display operation (e.g., data indicating a clock frequency for display; referred to below as "display control data") are sent to the display control circuit 200 from a CPU or suchlike of an external computer (the externally sent data Dv will be referred to below as the "broad image data"). Specifically, the external CPU or suchlike supplies the display control circuit 200 with (narrow) image data and display control data, which are included in the broad image data Dv, along with an address signal ADw, so that the image data and the display control data are respectively written to display memory and a register, which will be described later, in the display control circuit 200.

On the basis of the display control data written to the register, the display control circuit 200 generates various signals, including a source clock signal SCK and a source start pulse signal SSP, which are provided to the video signal line driver circuit 300 for display, and a gate clock signal GCK and a gate start pulse signal GSP, which are provided to the scanning signal line driver circuit 400 for display. These signals are known, and therefore, any detailed descriptions thereof will be omitted. Moreover, the display control circuit 200 reads the (narrow) image data written to the display memory by the external CPU or suchlike, from the display memory, and outputs the data as a digital image signal Da. In addition, the display control circuit 200 generates and outputs switching control signals $GS_1$ to $GS_6$ for driving the video signal lines in a time-division manner (these signals will also be referred to below as "switching control signals GS").

In this manner, among the signals generated by the display control circuit 200, the digital image signal Da is supplied to the video signal line driver circuit 300, and the switching control signals $GS_1$ to $GS_6$ are supplied to the video signal line driver circuit 300 and also to demultiplexers of the liquid crystal panel 500, which will be described later. Note that the number of signal lines provided to supply the digital image signal Da from the display control circuit 200 to the video signal line driver circuit 300 corresponds to the number of tones of images to be displayed.

In addition to the data that represents an image to be displayed in the display area 700 of the liquid crystal panel 500, which is serially supplied pixel by pixel as the digital image signal Da, the video signal line driver circuit 300 is supplied with timing-indicating signals, including the source clock signal SCK, the source start pulse signal SSP, and the switching control signals GS, as described above. On the basis of the digital image signal Da, the source clock signal SCK, the source start pulse signal SSP, and the switching control signals GS, the video signal line driver circuit 300 generates video signals for driving the display area 700 of the liquid crystal panel 500 (also referred to below as "drive video signals"), and outputs the signals to the video signal lines in the display area 700 via the demultiplexers to be described later. In this manner, the video signal line driver circuit 300 functions as a video signal output circuit for the demultiplexers. Moreover, the video signal line driver circuit 300 and the demultiplexers collectively function as a video-signal-line time-division drive portion. Note that the display control circuit 200 and the video signal line driver circuit 300 are often provided as a single IC mounted on a substrate of the liquid crystal panel by COG technology, and therefore, they may be configured as such here as well. Moreover, the display control circuit 200 and the video signal line driver circuit 300 may be configured as separate ICs, or may be configured in other well-known manners.

On the basis of the gate clock signal GCK and the gate start pulse signal GSP, the scanning signal line driver circuit 400 generates scanning signals $G_1$, $G_2$, $G_3$, and so forth, which are applied to the scanning signal lines in the display area 700 in order to sequentially select the scanning signal lines each for one horizontal scanning period, and the scanning signal line driver circuit 400 repeats application of active scanning signals to the scanning signal lines in cycles of one vertical scanning period in order to sequentially select all of the scanning signal lines.

In the display area 700, as described above, the video signal line driver circuit 300 applies drive video signals $S_1$, $S_2$, $S_3$, and so forth, based on the digital image signal Da to the video signal lines via the demultiplexers to be described later, and the scanning signal line driver circuit 400 applies the scanning signals $G_1$, $G_2$, $G_3$, and so forth, to the scanning signal lines. As a result, the display area 700 of the liquid crystal panel 500 displays the image that is represented by the image data Dv received from the external CPU or suchlike.

<1.2 Configuration and Operation of the Display Control Circuit>

Figure 2:
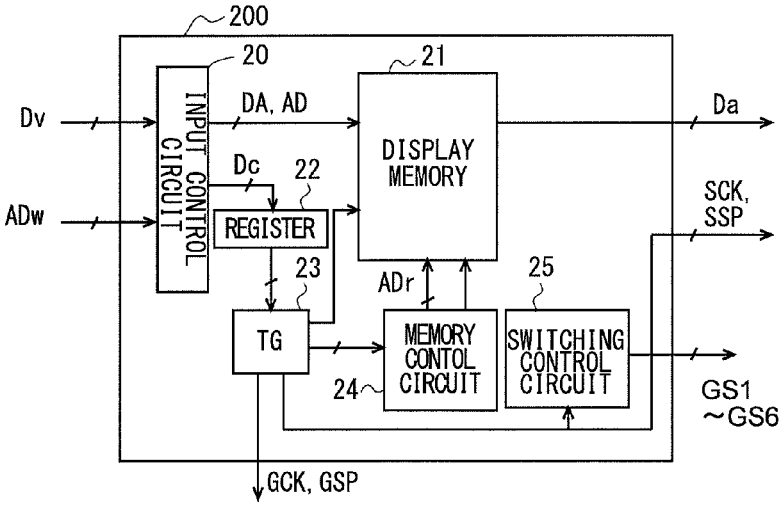
FIG. 2 is a block diagram illustrating the configuration of a display control circuit in the embodiment.

FIG. 2 is a block diagram illustrating the configuration of the display control circuit 200 of the liquid crystal display device 100. The display control circuit 200 includes an input control circuit 20, display memory 21, a register 22, a timing generation circuit 23, a memory control circuit 24, and a switching control circuit 25.

The display control circuit 200 receives a signal which provides the broad image data Dv (this signal will also be denoted below by the characters "Dv") and an address signal ADw from the external CPU or suchlike, and the received signals are inputted to the input control circuit 20. In accordance with the address signal ADw, the input control circuit 20 sorts the broad image data Dv into image data DA and display control data Dc. Thereafter, signals which represent the image data DA (these signals will also be denoted below by the characters "DA"), along with an address signal AD based on the address signal ADw, are supplied to the display memory 21, thereby writing the image data DA to the display memory 21, and also the display control data Dc is written to the register 22. The display control data Dc includes timing information that specifies frequencies of clock signals, including the source clock signal SCK, and also specifies horizontal and vertical scanning periods for displaying the image that is represented by the image data Dv.

The timing generation circuit (abbreviated below as "TG") 23 generates a source clock signal SCK and a source start pulse signal SSP on the basis of the display control data held in the register 22. Moreover, the TG 23 generates timing signals for causing the display memory 21 and the memory control circuit 24 to operate in synchronization with the source clock signal SCK.

The memory control circuit 24 generates an address signal ADr to read data that represents the image to be displayed in the display area 700 of the liquid crystal panel 500, from among the image data DA externally inputted and stored to the display memory 21 via the input control circuit 20, and also generates a signal to control the operation of the display memory 21. The address signal ADr and the control signal are provided to the display memory 21, so that the data that represents the image to be displayed in the display area 700 of the liquid crystal panel 500 is read from the display memory 21 and outputted from the display control circuit 200 as a digital image signal Da. The digital image signal Da is supplied to the video signal line driver circuit 300, as has already been described.

On the basis of the timing signal from the TG 23, the switching control circuit 25 generates switching control signals $GS_1$ to $GS_6$ to drive the video signal lines in a time-division manner. The switching control signals $GS_1$ to $GS_6$ are control signals to change video signal lines to which a video signal outputted by the video signal line driver circuit 300 is applied, within one horizontal scanning period, thereby driving the video signal lines in a time-division manner, as will be described later.

Figure 6:
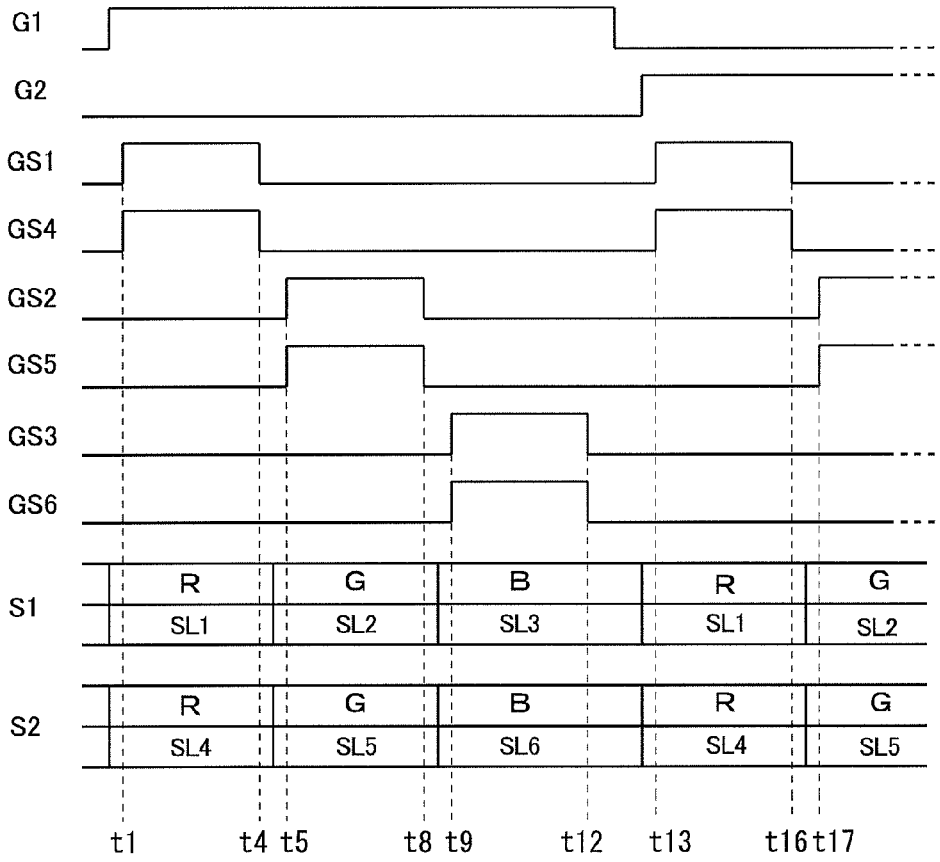
FIG. 6 is a timing chart describing a drive method for the liquid crystal display device in the embodiment.

In the present embodiment, as shown in FIG. 6 to be described later, signals that are set at H level during the first of three sections of each horizontal scanning period (the period for which the scanning signals are active) and at L level during the other sections are generated as switching control signals $GS_1$ and $GS_4$, the signals that are set at H level during the second section and at L level during the other sections are similarly generated as switching control signals $GS_2$ and $GS_5$, and signals that are set at H level during the third section and at L level during the other sections are generated as switching control signals $GS_3$ and $GS_6$. Note that the length from the first to third sections is set for convenience of explanation, and since in reality it is set considering delay time for each signal, signal generation does not always need to occur at the same time.

<1.3 Liquid Crystal Panel and Drive Method Therefor>

<1.3.1 Configuration of the Liquid Crystal Panel>

Figure 3:
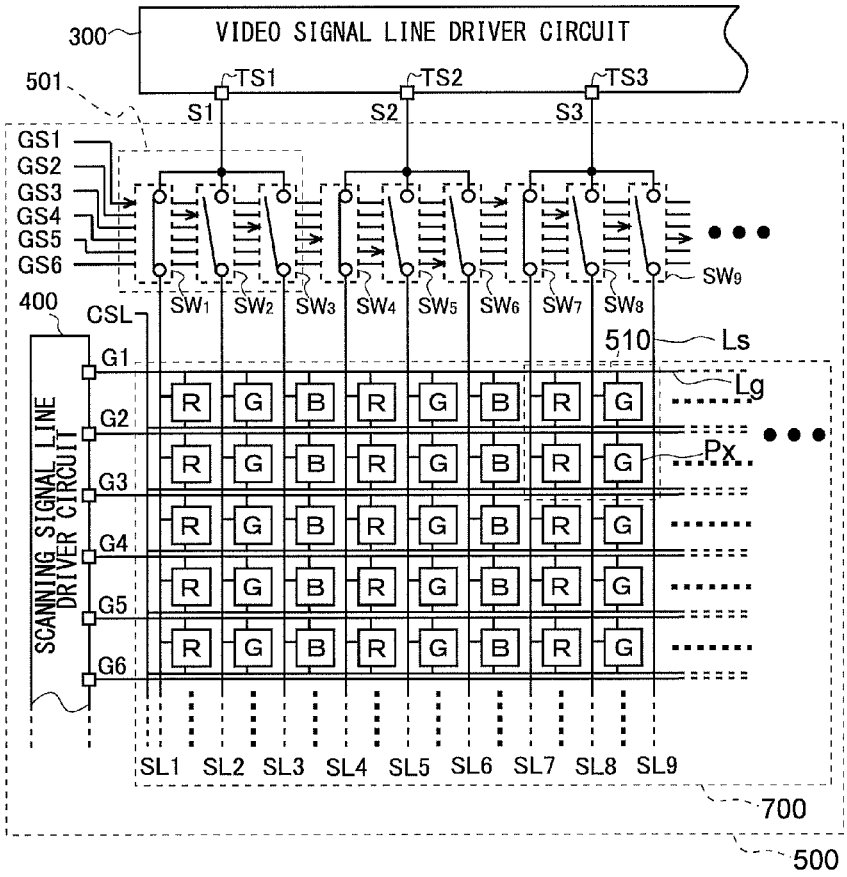
FIG. 3 is a schematic diagram illustrating the configuration of a liquid crystal panel in the embodiment.
Figure 4:
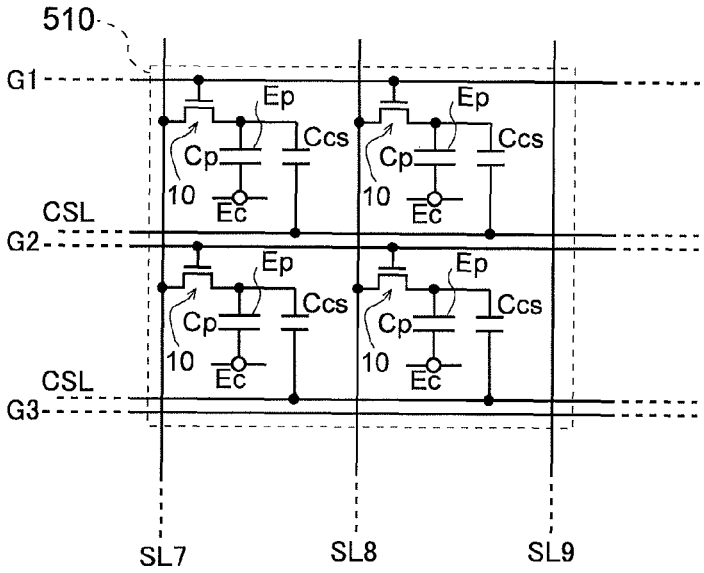
FIG. 4 is an equivalent circuit diagram of a part (a portion corresponding to four pixels) of the liquid crystal panel in the embodiment.
Figure 5:
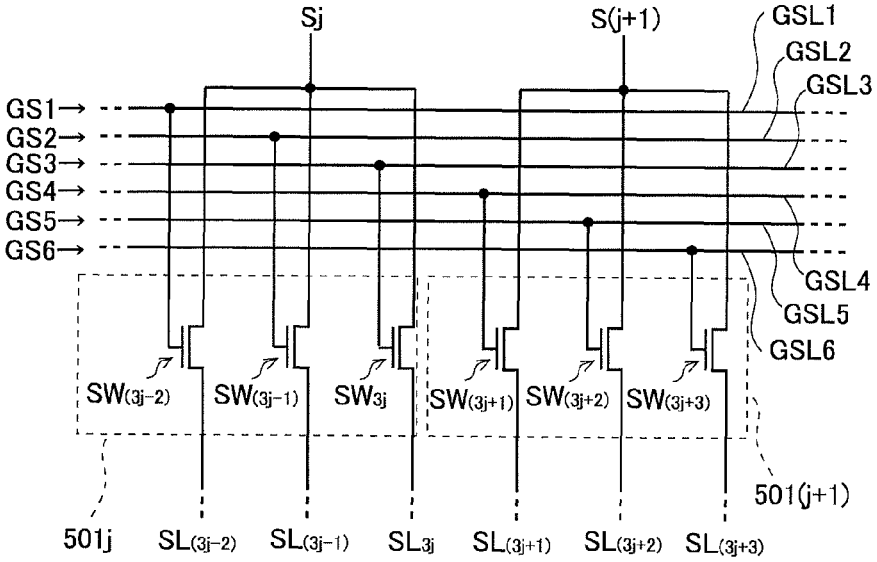
FIG. 5 is an equivalent circuit diagram illustrating change-over switches of the liquid crystal panel in the embodiment.

FIG. 3 is a schematic diagram illustrating the configuration of the liquid crystal panel 500 in the present embodiment, FIG. 4 is an equivalent circuit diagram of a part (a portion corresponding to four pixels) 510 of the liquid crystal panel, and FIG. 5 is an equivalent circuit diagram illustrating change-over switches (demultiplexers) for driving the video signal lines in a time-division manner.

The display area 700 of the liquid crystal panel 500 includes n (where n is a multiple of 3, e.g., 640×3) video signal lines $SL_1$, $SL_2$, . . . , $SL_n$ (in FIG. 3, video signal lines Ls) connected to the video signal line driver circuit 300 via demultiplexers, including a demultiplexer 501 consisting of switching elements $SW_1$, $SW_2$, and $SW_3$, and m (where m is a natural number, e.g., 480) scanning signal lines Lg connected to the scanning signal line driver circuit 400, and the video signal lines Ls and the scanning signal lines Lg are arranged in a grid so as to cross each other. A plurality of pixel forming portions Px are provided so as to correspond to the intersections of the video signal lines Ls and the scanning signal lines Lg, as has already been described. As shown in FIG. 4, each pixel forming portion Px consists of a TFT 10, which has a source terminal connected to the video signal line Ls that passes through its corresponding intersection, a gate terminal connected to the scanning signal line Lg that passes through the corresponding intersection, an auxiliary capacitor Ccs and a pixel electrode Ep connected to a drain terminal of the TFT 10, an opposing electrode Ec commonly provided to the pixel forming portions Px, and a liquid crystal layer provided between the opposing electrode Ec and the pixel electrode Ep. The pixel electrode Ep, the opposing electrode Ec, and the liquid crystal layer provided therebetween create pixel capacitance Cp. Moreover, an auxiliary capacitance line CSL, which is commonly provided to the pixel forming portions Px, is connected to one of the terminals of the auxiliary capacitor Ccs, which is different from the terminal connected to the drain terminal of the TFT 10.

The pixel forming portions Px as above are arranged in a matrix to constitute a pixel-formation matrix. Incidentally, the pixel electrodes Ep, which are essential parts of the pixel forming portions Px, are in one-to-one correspondence with pixels in an image displayed on the liquid crystal panel, and therefore can be considered the same as the pixels. Accordingly, for convenience of explanation, the pixel forming portions Px will be considered below the same as pixels, and the "pixel-formation matrix" will also be referred to as the "pixel matrix".

In FIG. 3, "R", "G", or "B" is assigned to each pixel forming portion Px to represent the color red, green, or blue of the pixel formed by that pixel forming portion Px. Note that these colors are three typical primary colors, but they may be another combination of three primary colors. Moreover, in a general liquid crystal display device, polarity inversion drive is performed to suppress liquid crystal deterioration and maintain display quality. The polarity inversion drive mode employed in the present embodiment is a so-called line-inversion drive mode in which the polarity of a voltage applied to the liquid crystal layer included in the pixels is inverted every scanning signal line and also every frame. Moreover, instead of employing the line-inversion drive mode, other drive modes may be employed, including a frame-inversion drive mode, in which the polarity of a voltage applied to the liquid crystal is simply inverted every frame, and a dot-inversion drive mode, in which the polarity of a voltage applied to the liquid crystal is inverted every scanning signal line and also every video signal line (and further every frame).

The liquid crystal panel has formed thereon some portions to connect the video signal lines Ls to the video signal line driver circuit 300, including the demultiplexer 501 (FIG. 3) consisting of the switching elements $SW_1$, $SW_2$, and $SW_3$, as described above, which correspond to their respective video signal lines Ls on the liquid crystal panel, and the switching elements $SW_1$, $SW_2$, $SW_3$, $SW_4$, and so forth, are divided into groups of three adjacent switching elements (the number of groups being ⅓ of the number of video signal lines Ls). The three switching elements included in each group are connected at one end to their corresponding video signal lines Ls and at the other end to one output terminal $TS_j$ (j=1, 2, 3, . . . ) of the video signal line driver circuit 300. In this manner, the video signal lines Ls of the liquid crystal panel are divided into groups of three, and each video signal line group (three video signal lines Ls in the same group) is connected to one output terminal $TS_j$ of the video signal line driver circuit 300 via three switching elements that are grouped to form one demultiplexer. The output terminal $TS_j$ of the video signal line driver circuit 300 is in one-to-one correspondence with the video signal line group, and is connected to the same group of video signal lines (three video signal lines Ls) via three switching elements in the same group.

Note that each switching element SWi is, for example, a thin-film transistor (TFT) having a well-known configuration with a semiconductor layer of polysilicon (p-Si), and typically formed on the glass substrate of the liquid crystal panel. Moreover, the semiconductor layer may be made of microcrystalline silicon (μc-Si), amorphous silicon (a-Si) or an oxide semiconductor such as zinc oxide (ZnO), rather than polysilicon.

As shown in FIG. 5, three switching elements $SW_{(3j-2)}$, $SW_{(3j-1)}$, and $SW_{3j}$ grouped to form a demultiplexer $\mathbf{501}_j$ are turned on/off in accordance with switching control signals $GS_1$ to $GS_3$, which are inputted from the left ends of the switching control signal lines $GSL_1$ to $GSL_3$ and transmitted through the switching control signal lines $GSL_1$ to $GSL_3$ (where j=1, 3, 5, . . . ). Note that the left ends of the switching control signal lines $GSL_1$ to $GSL_3$ are coupled to the display control circuit 200 by unillustrated lines. Moreover, these three switching elements in the same group are adjacent to a (or another) group of three switching elements $SW_{(3j+1)}$ $SW_{(3j+2)}$ and $SW_{(3j+3)}$, which constitute a demultiplexer $\mathbf{501}_{(j+1)}$, and are turned on/off in accordance with switching control signals $GS_4$ to $GS_6$, which are transmitted through switching control signal lines $GSL_4$ to $GSL_6$ (where j=1, 3, 5, . . . ). Although not shown in FIG. 5, two adjacent groups, totaling six switching elements, are repeatedly arranged to form demultiplexers corresponding to the respective groups.

In this manner, the two adjacent groups shown in FIG. 5 total six switching elements, hence six change-over switches, and two corresponding switching elements from these different groups are simultaneously turned on/off. In this manner, three change-over switches in the same group connect each output terminal $TS_j$ of the video signal line driver circuit 300 to three video signal lines in a video signal line group corresponding to that output terminal in a time-division manner.

The switching element $SW_i$ is, for example, an n-channel TFT, which receives a corresponding one of the switching control signals $GS_1$ to $GS_6$ at a gate terminal and is rendered conductive between its source and drain when the received switching control signal is at H level. Moreover, as will be described in detail later, for six switching elements $SW_{(3j-2)}$, $SW_{(3j-1)}$, $SW_{3j}$, $SW_{(3j+1)}$, $SW_{(3j+2)}$, and $SW_{(3j+3)}$ in two adjacent groups, two corresponding elements from these different groups are sequentially turned on in accordance with the switching control signals $GS_1$ to $GS_6$, with the remaining four being off. A drive method for the liquid crystal display device 100, including the switching operation of the switching elements, will be described below with reference to FIG. 6.

<1.3.2 Drive Method>

FIG. 6 is a timing chart describing the drive method for the present liquid crystal display device. The scanning signals $G_1$, $G_2$, and so forth, which are sequentially set at H level for one horizontal scanning period (one scanning-line selection period) each, as shown in FIG. 6, are applied to the scanning signal lines Lg of the liquid crystal panel. In response to the scanning signals $G_1$, $G_2$, and so forth, the scanning signal lines Lg are brought into a selected state (active) upon application of H level, so that the TFTs 10 of the pixel forming portions Px connected to the scanning signal lines Lg in the selected state are turned on; on the other hand, an unselected state (non-active) is brought about upon application of L level, so that the TFTs 10 of the pixel forming portions Px connected to the scanning signal lines Lg in the unselected state are turned off. Note that the waveforms shown in FIG. 6 are simplified, and in actuality, the more waveform rounding, the more distance from the input terminal of the signal. That is, the period for which the signal is kept at H level is shortened.

Here, as shown in FIG. 6, the switching control signals $GS_1$ and $GS_4$ are set at H level during the first (in the figure, the section spanning from time $t_1$ to time $t_4$) of three sections of each horizontal scanning period (for which each scanning signal $G_k$ (k=1, 2, 3, . . . ) is at H level), and they are set at L level during the remaining period (in the figure, the period spanning from time $t_4$ to time $t_{13}$). Similarly, the switching control signals $GS_2$ and $GS_5$ are set at H level during the second section (in the figure, the section spanning from time $t_5$ to time $t_8$), and they are set at L level during the remaining period. Moreover, the switching control signals $GS_3$ and $GS_6$ are set at H level during the third section (in the figure, the section spanning from time $t_9$ to time $t_{12}$), and they are set at L level during the remaining period.

Note that in the timing chart of FIG. 6, each of the video signals $S_1$ and $S_2$, which are to be outputted from the output terminals $TS_1$ and $TS_2$, respectively, of the video signal line driver circuit 300, is shown in two rows; the upper row indicates (pixel values of) the colors to be displayed by the pixel forming portions Px in accordance with the video signal $S_1$ or $S_2$, and the lower row indicates the video signal lines to which the video signal $S_1$ or $S_2$ is applied. As shown in FIG. 6, pixel values to be written to the pixel forming portions Px whose TFTs 10 are turned on in response to the scanning signal $G_1$ (here, pixel values for displaying R, G, and B pixels) are sequentially inputted by the display control circuit 200, and video signals $S_1$ corresponding to the pixel values are outputted from the output terminals $TS_j$ in the first through third sections of the horizontal scanning period. Such an operation is repeated every horizontal scanning period, so that an image is displayed on the liquid crystal panel 500 in one frame period.

In the present embodiment, unlike in the conventional configuration with the switching operation of the switching elements being controlled in accordance with three switching control signals, the switching operation of the switching elements is controlled in accordance with the switching control signals $GS_1$ to $GS_6$, as described above, but the switching control signal $GS_1$, the switching control signal $GS_2$, and the switching control signal $GS_3$ change with the same timing as, respectively, the switching control signal $GS_4$, the switching control signal $GS_5$, and the switching control signal $GS_6$, so that the switching operation of the switching elements is performed in the same manner as conventional.

However, as can be appreciated with reference to FIG. 5, the switching control signals $GS_1$ to $GS_3$ are transmitted by the switching control signal lines $GSL_1$ to $GSL_3$, and the switching control signals $GS_4$ to $GS_6$ are transmitted by the switching control signal lines $GSL_4$ to $GSL_6$, so that they do not interfere with each other; the number of switching elements coupled to each of the switching control signal lines $GSL_1$ to $GSL_6$ is a half of that in the conventional configuration. As a result, the load on the switching control signal lines $GSL_1$ to $GSL_6$ from the transistors connected thereto is almost halved, so that waveform rounding of the transmitted switching control signals $GS_1$ to $GS_6$ is less than conventional. Note that in the present embodiment, the switching control signals $GS_1$ to $GS_6$ are inputted from the left end, but they may be inputted from the right end.

<1.4 Effect of the First Embodiment>

As described above, in the present embodiment, the number of switching control signal lines for transmitting switching control signals that are to be provided to switching elements coupled to video signal lines in a display device employing the video-signal-line time-division drive mode is twice the number of time divisions (here, three, hence six switching control signal lines), and switching control signals with the same timing are transmitted by two switching control signal lines, so that the number of switching elements coupled to the switching control signal lines can be reduced to a half. As a result, waveform rounding of the switching control signals transmitted by the switching control signal lines can be reduced. Thus, an appropriate turn-on time can be ensured for each switching element, whereby display defects due to insufficient charge in the pixel forming portions can be inhibited or eliminated.

<1.5 Variants of the First Embodiment>

<1.5.1 First Variant>

Figure 7:
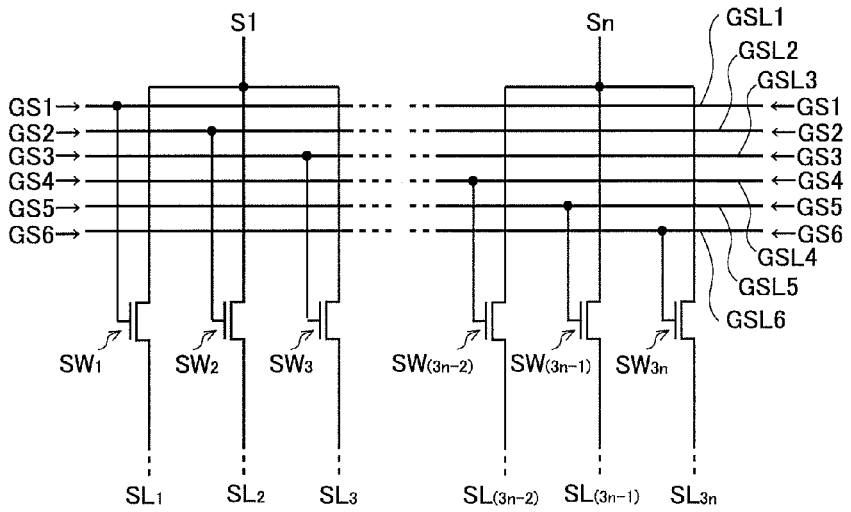
FIG. 7 is a diagram illustrating equivalent circuits of change-over switches in a first variant of the embodiment, along with input directions of switching control signals.

FIG. 7 is a diagram illustrating equivalent circuits of change-over switches in a first variant of the first embodiment, along with input directions of switching control signals. Switching elements shown in FIG. 7 are connected to their corresponding switching control signal lines $GSL_1$ to $GSL_6$ in the same manner as in the first embodiment, but as can be appreciated in comparison with FIG. 5, the switching control signals $GS_1$ to $GS_6$ are inputted (applied) to the switching control signal lines $GSL_1$ to $GSL_6$ from both ends.

In addition to the lines provided as in the first embodiment, extending from the display control circuit 200 to one end of the switching control signal lines $GSL_1$ to $GSL_6$, this configuration requires lines extending to the other end, so that the frame area of the liquid crystal panel 500 might conceivably be increased. In this regard, the configuration of the first embodiment, which simply uses the frame area near the one end of the switching control signal lines $GSL_1$ to $GSL_6$, might be more preferred.

However, the switching control signals $GS_1$ to $GS_6$, which are inputted to the switching control signal lines $GSL_1$ to $GSL_6$ from both ends, have waveform rounding that increases from both ends toward the center (due to, for example, the load on the lines from the switching elements connected thereto), and the maximum waveform rounding (at the center) is less than the maximum waveform rounding in the first embodiment. Therefore, even in a high-resolution liquid crystal panel with a number of video signal lines, an appropriate turn-on time can be ensured for each switching element, whereby display defects due to insufficient charge in the pixel forming portions can be inhibited or eliminated. Note that an increase in the frame area of the liquid crystal panel 500 can be minimized by utilizing a wiring area outside the liquid crystal panel (e.g., a wiring area on an FPC board or a wiring area on a system board) in such a manner that the input terminals for the switching control signals $GS_1$ to $GS_6$ are provided on the liquid crystal panel 500 in positions respectively close to the left and right edges of the demultiplexer area 600. Moreover, in the case where an IC that includes the display control circuit 200 is mounted on the liquid crystal panel 500 by COG technology, an increase in the frame area of the liquid crystal panel 500 can be minimized by providing the output terminals for the switching control signals $GS_1$ to $GS_6$ at the left and right edges of the IC (in positions respectively close to the left and right edges of the demultiplexer area 600).

<1.5.2 Second Variant>

Figure 8:
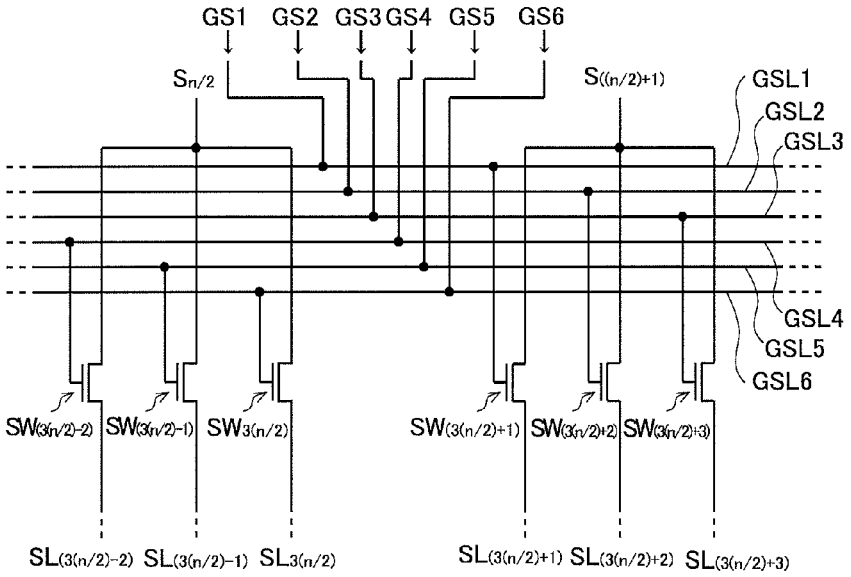
FIG. 8 is a diagram illustrating equivalent circuits of change-over switches in a second variant of the embodiment, along with input directions of switching control signals.

FIG. 8 is a diagram illustrating equivalent circuits of change-over switches in a second variant of the first embodiment, along with input directions of switching control signals. The switching elements shown in FIG. 8 are connected to their corresponding switching control signal lines $GSL_1$ to $GSL_6$ in the same manner as in the first embodiment, but unlike in FIG. 5 or 7, as can be appreciated in comparison therewith, the switching control signals $GS_1$ to $GS_6$ are inputted (applied) to the switching control signal lines $GSL_1$ to $GSL_6$ from the center.

In place of the lines extending from the display control circuit 200 to one or both ends of the switching control signal lines $GSL_1$ to $GSL_6$ as in the first embodiment or the first variant, this configuration requires the lines for input to the center of the switching control signal lines $GSL_1$ to $GSL_6$, and therefore, in some cases, it might be difficult to secure an area for such wiring in a (high-resolution) liquid crystal panel with a number of video signal lines.

However, the switching control signals $GS_1$ to $GS_6$ inputted to the switching control signal lines $GSL_1$ to $GSL_6$ from the center have waveform rounding that increases from the center toward both ends (due to, for example, the load on the lines from the switching elements connected thereto), but the maximum waveform rounding (at both ends) is less than the maximum waveform rounding in the first embodiment. Therefore, while keeping a low number of lines from the display control circuit 200 to the switching control signal lines $GSL_1$ to $GSL_6$ as in the first embodiment, it is possible to ensure an appropriate turn-on time for each switching element, thereby inhibiting or eliminating display defects due to insufficient charge in the pixel forming portions. Note that in the case where the input terminals for the switching control signals $GS_1$ to $GS_6$ are arranged on the liquid crystal panel 500 in a position near the center of the demultiplexer area 600, the connection distance from the input terminals for the switching control signals $GS_1$ to $GS_6$ to the switching control signal lines $GSL_1$ to $GSL_6$ can be minimized, so that a sufficient wiring area can be ensured. Moreover, in the case where an IC that includes the display control circuit 200 is mounted on the liquid crystal panel 500 by COG technology, the output terminals for the switching control signals $GS_1$ to $GS_6$ are provided at the center of the IC (in a position near the center of the demultiplexer area 600), thereby minimizing the connection distance from the input terminals for the switching control signals $GS_1$ to $GS_6$ to the switching control signal lines $GSL_1$ to $GSL_6$, as in the aforementioned case, so that a sufficient wiring area can be ensured.

<1.5.3 Other Variants>

While the above embodiment has been described with respect to the example where the switching elements $SW_1$ to $SW_3$, $SW_7$ to $SW_9$, . . . , $SW_{(3j-2)}$ to $SW_{3j}$, and so forth, are connected to the switching control signal lines $GSL_1$ to $GSL_3$, and the switching elements $SW_4$ to $SW_6$, $SW_{10}$ to $SW_{12}$, . . . , $SW_{(3j+1)}$ to $SW_{(3j+3)}$, and so forth, are connected to the switching control signal lines $GSL_4$ to $GSL_6$, the arrangement of the switching control signal lines $GSL_1$ to $GSL_6$ and the switching elements is not specifically limited, so long as three pairs of switching control signal lines for activating two corresponding switching elements, totaling six switching control signal lines, are provided in order to sequentially activate six switching elements from two different sets of three such that two corresponding switching elements, one from each set, are activated at a time. For example, in the case where the total number of switches is 480, switching elements $SW_1$ to $SW_3$, $SW_4$ to $SW_6$, . . . , and $SW_{238}$ to $SW_{240}$ may be connected to the switching control signal lines $GSL_1$ to $GSL_3$, and switching elements $SW_{241}$ to $SW_{243}$, $SW_{244}$ to $SW_{246}$, . . . , and $SW_{478}$ to $SW_{480}$ may be connected to the switching control signal lines $GSL_4$ to $GSL_6$. Note that the same can be applied to the variants of the present embodiment, embodiments to be described below, etc., as well.

In the above embodiment, the number of time divisions for the video-signal-line time-division drive mode is three, and the number of switching control signal lines is twice the number, i.e., six, but the number of time divisions may be two or even four or more, and the number of switching control signal lines may be three times, or more than three times, the number of time divisions, that being two or more. For example, in the configuration where the number of time divisions is three, and the number of switching control signal lines is nine, switching control signals with the same timing are transmitted by three switching control signal lines, and therefore the number of switching elements to be coupled to the switching control signal lines can be reduced to ⅓, so that waveform rounding of the switching control signals can be further reduced. However, considering prevention of an excessively large frame area of the liquid crystal panel and prevention of insufficient charge in the pixel forming portions, it is often practical to set the number of switching control signal lines to four times or less than four times (12 or less) the conventional number.

Furthermore, while the switching control signals are inputted near the center of the switching control signal lines in the second variant, they may be inputted from another input point or from two or more input points. For example, a combination with the present embodiment or the first variant is also conceivable.

<2. Second Embodiment>

<2.1 Configuration and Operation of the Liquid Crystal Display Device>

Except that a plurality of buffer circuits are provided on the liquid crystal panel 500 at the left ends of the switching control signal lines $GSL_1$ to $GSL_6$, and the display control circuit 200 outputs three switching control signals, the configuration and the operation of the liquid crystal display device 100 according to a second embodiment of the present invention is approximately the same as in the first embodiment, therefore, the same elements are denoted by the same characters, and any descriptions thereof will be omitted. The buffer circuits provided on the liquid crystal panel 500 will be described below with reference to FIG. 9.

<2.2 Configuration and Operation of the Buffer Circuit>

Figure 9:
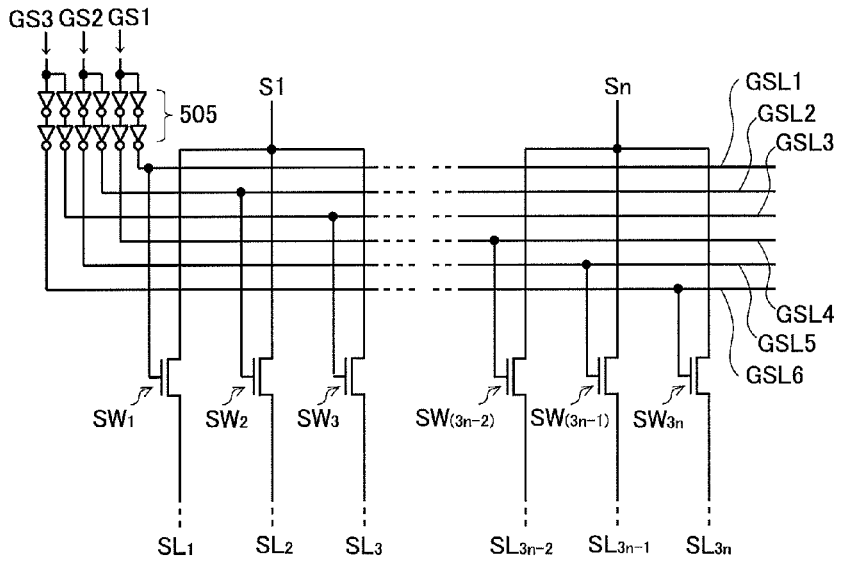
FIG. 9 is a diagram illustrating equivalent circuits of change-over switches in a second embodiment of the present invention, along with buffer circuits.

FIG. 9 is a diagram illustrating equivalent circuits of change-over switches in the second embodiment, along with buffer circuits. As shown in FIG. 9, switching control signals $GS_1$ to $GS_3$ outputted by the display control circuit 200 are split into two immediately before they are provided to a plurality of buffer circuits 505, so that the switching control signal $GS_1$, the switching control signal $GS_2$, and the switching control signal $GS_3$ are respectively provided to switching control signal lines $GSL_1$ and $GSL_4$, switching control signal lines $GSL_2$ and $GSL_5$, and switching control signal lines $GSL_3$ and $GSL_6$ through their corresponding buffer circuits 505.

Specifically, the buffer circuits 505 are provided one for each of the switching control signal lines $GSL_1$ to $GSL_6$/and in FIG. 9, one buffer circuit is formed by two inverters (NOT logic circuits) connected in a series. The buffer circuits are formed on a glass substrate near the left ends of the switching control signal lines $GSL_1$ to $GSL_6$. Note that the buffer circuits shown in FIG. 9 are simplified illustrations, and various well-known circuits can be employed so long as they have the capability of properly driving their corresponding switching control signal lines. Moreover, the buffer circuits do not have to be formed on the glass substrate, so long as they are provided between the output terminals of the display control circuit 200 and the switching control signal lines $GSL_1$ to $GSL_6$.

With such a configuration, the switching control signal lines $GSL_1$ to $GSL_6$ are driven by the buffer circuits 505, and the number of lines up to the point of the buffer circuits 505 is halved compared to the first embodiment, resulting in simplified wiring. Moreover, the number of switching control signals outputted by the display control circuit 200 is halved, resulting in a simplified configuration of the display control circuit 200. Note that in this case, the display control circuit 200 can be used with the same configuration as the conventional display control circuit, and therefore, development cost is kept low. Note that in the present embodiment, the buffer circuits 505 are formed on the glass substrate near the left ends of the switching control signal lines $GSL_1$ to $GSL_6$, but they may be formed on a glass substrate near the right ends of the switching control signal lines $GSL_1$ to $GSL_6$.

<2.3 Effects of the Second Embodiment>

As described above, in the present embodiment, as in the first embodiment, the number of switching control signal lines for transmitting switching control signals that are to be provided to switching elements coupled to video signal lines in a display device employing the video-signal-line time-division drive mode is twice the number of time divisions (here, three, hence six switching control signal lines), and the same switching control signal is transmitted by two switching control signal lines via the buffer circuits, so that the number of switching elements coupled to the switching control signal lines can be halved. As a result, waveform rounding of the switching control signals transmitted by the switching control signal lines can be reduced. Thus, an appropriate turn-on time can be ensured for each switching element, whereby display defects due to insufficient charge in the pixel forming portions can be inhibited or eliminated.

Moreover, as in the conventional configuration, the wiring from the display control circuit 200 to the buffer circuits 505 can be simplified compared to the first embodiment, and the number of switching control signals outputted by the display control circuit 200 is not increased, resulting in a simplified configuration of the display control circuit 200.

<2.4 Variants of the Second Embodiment>

<2.4.1 First Variant>

Figure 10:
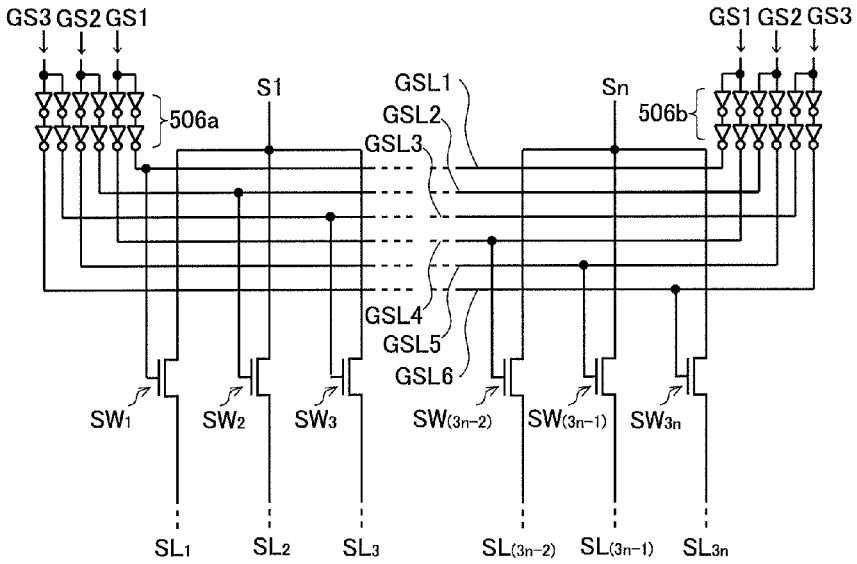
FIG. 10 is a diagram illustrating equivalent circuits of change-over switches in a first variant of the embodiment, along with buffer circuits.

FIG. 10 is a diagram illustrating equivalent circuits of change-over switches in a first variant of the second embodiment, along with buffer circuits. The switching elements shown in FIG. 10 are connected to their corresponding switching control signal lines $GSL_1$ to $GSL_6$ in the same manner as in the first and second embodiments, but as can be appreciated in comparison with FIG. 9, there is a difference in that the switching control signals $GS_1$ to $GS_3$ to be inputted are provided to a plurality of sets of buffer circuits 506*a* and 506*b* provided at either end of the switching control signal lines $GSL_1$ to $GSL_6$. Specifically, each of the switching control signal lines $GSL_1$ to $GSL_6$ is provided with one buffer circuit 506*a* at the left end and one buffer circuit 506*b* at the right end.

In addition to the buffer circuits 506*a* provided in the same manner as in the second embodiment, this configuration further requires the buffer circuits 506*b* and therefore is complicated, conceivably resulting in an increased frame area of the liquid crystal panel 500. In this regard, the configuration of the second embodiment might be more preferred.

However, the switching control signals $GS_1$ to $GS_3$ inputted from both ends of the switching control signal lines $GSL_1$ to $GSL_6$ via the buffer circuits 506*a* and 506*b*, have waveform rounding that increases from both ends toward the center (due to, for example, the load on the lines from the switching elements connected thereto), but the maximum waveform rounding (at the center) is less than the maximum waveform rounding in the second embodiment. Therefore, even in a high-resolution liquid crystal panel with a number of video signal lines, an appropriate turn-on time can be ensured for each switching element, whereby display defects due to insufficient charge in the pixel forming portions can be inhibited or eliminated. Note that by utilizing a wiring area outside the liquid crystal panel (e.g., a wiring area on an FPC board or a wiring area on a system board) in such a manner that the input terminals for the switching control signals $GS_1$ to $GS_3$ are provided on the liquid crystal panel 500 in positions respectively close to the left and right edges of the demultiplexer area 600, it is rendered possible to inhibit an increase in the wiring area and thereby minimize an increase in the frame area of the liquid crystal panel 500. Moreover, in the case where an IC that includes the display control circuit 200 is mounted on the liquid crystal panel 500 by COG technology, the output terminals for the switching control signals $GS_1$ to $GS_3$ are provided at the left and right edges of the IC (in positions close to the left and right edges of the demultiplexer area 600), thereby minimizing an increase in the frame area of the liquid crystal panel 500, as in the aforementioned case.

<2.4.2 Second Variant>

Figure 11:
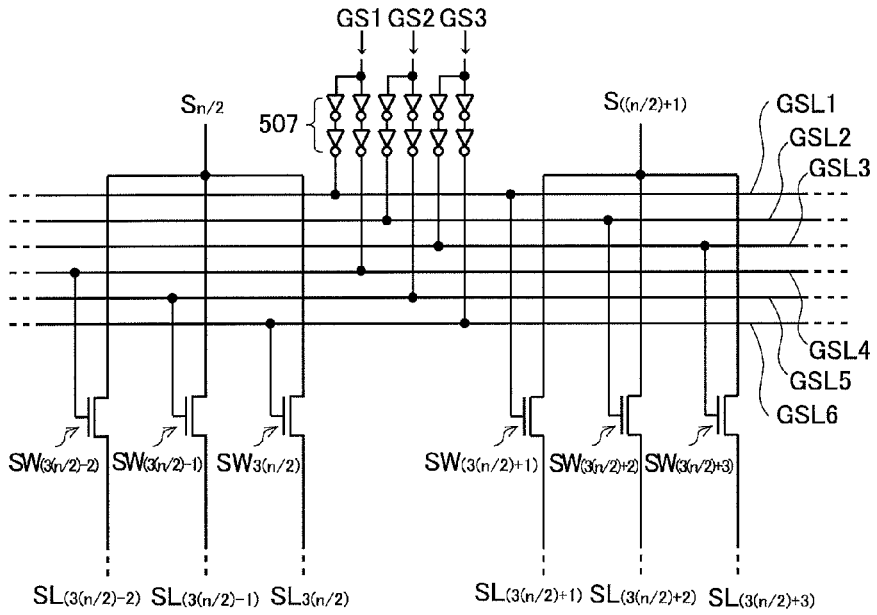
FIG. 11 is a diagram illustrating equivalent circuits of change-over switches in a second variant of the embodiment, along with buffer circuits.

FIG. 11 is a diagram illustrating equivalent circuits of change-over switches in a second variant of the second embodiment, along with buffer circuits. The switching elements shown in FIG. 11 are connected to their corresponding switching control signal lines $GSL_1$ to $GSL_6$ in the same manner as in the second embodiment, but as can be appreciated in comparison with FIG. 9 or 10, there is a difference in that the switching control signals $GS_1$ to $GS_3$ to be inputted are provided to a plurality of buffer circuits 507 provided at the center of the switching control signal lines $GSL_1$ to $GSL_6$. Specifically, the buffer circuits 507 are provided one for each of the switching control signal lines $GSL_1$ to $GSL_6$, as in the second embodiment.

In place of the buffer circuits provided near one or both ends of the switching control signal lines $GSL_1$ to $GSL_6$ from the display control circuit 200 as in the second embodiment or the first variant thereof, this configuration requires the buffer circuits 507 provided near the center of the switching control signal lines $GSL_1$ to $GSL_6$, and further requires the switching control signals, which are outputted by the buffer circuits 507, to be inputted at the center of the switching control signal lines $GSL_1$ to $GSL_6$, which often causes difficulty in securing a wiring area in a (high-resolution) liquid crystal panel with a number of video signal lines.

However, the switching control signals $GS_1$ to $GS_3$ inputted to the switching control signal lines $GSL_1$ to $GSL_6$ from the center have waveform rounding that increases from the center toward both ends (due to, for example, the load on the lines from the switching elements connected thereto), but the maximum waveform rounding (at both ends) is less than the maximum waveform rounding in the second embodiment. Therefore, while keeping a low number of buffer circuits 507*b* as in the second embodiment, it is possible to ensure an appropriate turn-on time for each switching element, thereby inhibiting or eliminating display defects due to insufficient charge in the pixel forming portions. Note that in the case where the input terminals for the switching control signals $GS_1$ to $GS_3$ are arranged on the liquid crystal panel 500 in a position near the center of the demultiplexer area 600, the connection distance from the input terminals for the switching control signals $GS_1$ to $GS_3$ to the buffer circuits 507 can be minimized, so that an increase in the wiring area can be minimized. Moreover, in the case where an IC that includes the display control circuit 200 is mounted on the liquid crystal panel 500 by COG technology, the output terminals for the switching control signals $GS_1$ to $GS_3$ are provided at the center of the IC (in a position near the center of the demultiplexer area 600), thereby minimizing the connection distance from the input terminals for the switching control signals $GS_1$ to $GS_3$ to the buffer circuits 507, as in the aforementioned case, so that an increase in the wiring area can be minimized.

<2.4.3 Other Variants>

As described in the "Other Variants" section of the first embodiment, the number of time divisions may be two or even four or more, and the number of switching control signal lines may be three times, or more than three times, the number of time divisions, that being two or more. Moreover, as in the second variant, the switching control signals may be inputted to the switching control signal lines at a position other than near the center thereof, and the number of input points may be two or more.

<3. Third Embodiment>

<3.1 Configuration and Operation of the Liquid Crystal Display Device>

The liquid crystal display device 100 according to a third embodiment of the present invention differs from that in the first embodiment in terms of the waveforms of the switching control signals $GS_1$ to $GS_6$, hence the controlled timing of driving the switching elements (the demultiplexers including them). Other features are the same as in the first embodiment, therefore, the same elements are denoted by the same reference characters, and any descriptions thereof will be omitted. A drive method for the liquid crystal display device 100, including the switching operation by the switching elements provided on the liquid crystal panel 500, will be described below with reference to FIG. 12.

<3.2 Drive Method>

Figure 12:
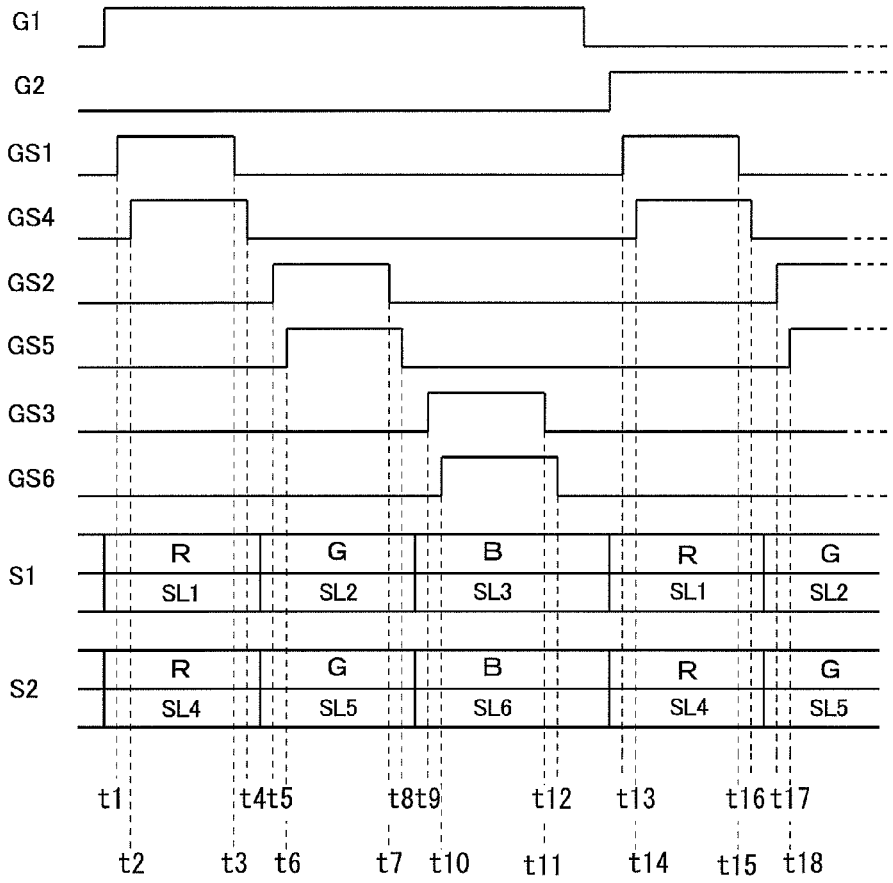
FIG. 12 is a timing chart describing a drive method for a liquid crystal display device in a third embodiment of the present invention.

FIG. 12 is a timing chart describing a drive method for the liquid crystal display device. As can be appreciated in comparison with FIG. 6, the switching control signals $GS_1$ and $GS_4$ shown in FIG. 12 are not synchronously set at H level during the first (in the figure, the section spanning from time $t_1$ to time $t_4$) of the three sections of each horizontal scanning period (for which each scanning signal $G_k$ (k=1, 2, 3, . . . ) is set at H level), and the switching control signal $GS_4$ has a phase lag relative to the switching control signal $GS_1$. Specifically, the switching control signal $GS_1$ is set at H level from time $t_1$ to time $t_3$ in the first section, and at L level for the rest of the first section. Moreover, the switching control signal $GS_4$ is set at H level from time $t_2$ to time $t_4$ in the first section, and at L level for the rest of the first section.

Here, the length from time $t_1$ to time $t_2$ is equal to the length from time $t_3$ to time $t_4$, and therefore, by this time period (referred to below as the "delay time"), the pulse of the switching control signal $GS_4$ rises (to H level) later than the pulse of the switching control signal $GS_1$. Accordingly, the load on a power source that provides an H-level potential to the display control circuit 200 for control signal generation (referred to below as an "H-power source") can be dispersed. This reduces the peak value of instant current that flows through the power source, so that malfunction or suchlike due to power source noise can be inhibited or eliminated.

Specifically, in the first embodiment, the transistor load on the switching control signal lines $GSL_1$ and $GSL_4$ for transmitting the switching control signals $GS_1$ and $GS_4$ is half of the conventional load, but as described earlier, the switching control signals $GS_1$ and $GS_4$ are equal in waveform, and therefore, the instant load on the H-power source at the rise of these pulse signals is equal to or greater than conventional. However, in the present embodiment, the instant load on the H-power source is dispersed and approximately halved, reducing the maximum value of the instantaneous current (inrush current) that flows through loads (in order to charge the loads), so that noise generation by the H-power source can be inhibited. Moreover, the load can be similarly dispersed at the fall of the pulse signals as well, reducing the maximum value of the instantaneous current (inrush current) that flows through a power source that provides an L-level potential to the display control circuit 200 (referred to below as an "L-power source"), so that noise generation by the L-power source can be inhibited as well.

Note that as can be appreciated with reference to FIG. 12, similarly, the switching control signals $GS_2$ and $GS_5$ are not synchronously set at H level during the second (in the figure, the section spanning from time $t_5$ to time $t_8$) of the three sections of each horizontal scanning period, and the switching control signal $GS_5$ has a phase lag relative to the switching control signal $GS_2$ by a delay time (here, the length from time $t_5$ to time $t_6$ or the length from time $t_7$ to time $t_8$). Moreover, the switching control signals $GS_3$ and $GS_6$ are not synchronously set at H level during the third section, and the switching control signal $GS_6$ has a phase lag relative to the switching control signal $GS_3$ by a delay time (here, the length from time $t_9$ to time $t_{10}$ or the length from time $t_{11}$ to time $t_{12}$). Accordingly, the maximum instantaneous current (inrush current) can be reduced for both the H-power source and the L-power source, as described above, so that noise from the H-power source and the L-power source can be suppressed.

<3.3 Effects of the Third Embodiment>

As described above, the present embodiment achieves an effect similar to that achieved by the first embodiment with a similar configuration, and also reduces the maximum instantaneous current (inrush current) in the power source, so that power source noise can be inhibited. Thus, malfunction (or undesirable operations or suchlike) of the display device due to power source noise can be inhibited or eliminated.

However, for the switching control signals $GS_1$ to $GS_6$, the duration of the H level (active period) in the first embodiment is longer than that in the third embodiment by a delay time, and therefore, the first embodiment might be more preferable in that a turn-on time for each switching element can be maintained as long as possible.

<3.4 Variants of the Third Embodiment>

The present embodiment has been described as having the same configuration as the first embodiment (except for the operations related to the switching control signals), and the configuration of the present embodiment can be similarly applied to the variants of the first embodiment to achieve similar effects.

In the present embodiment, the delay times of the switching control signals $GS_4$, $GS_5$, and $GS_6$ from the switching control signals $GS_1$, $GS_2$, and $GS_3$ are equal, but they may be different. Moreover, the switching control signals $GS_4$, $GS_5$, and $GS_6$ have been described as signals delayed from the switching control signals $GS_1$, $GS_2$, and $GS_3$, but the switching control signals $GS_1$, $GS_2$, and $GS_3$ may be signals delayed from the switching control signals $GS_4$, $GS_5$, and $GS_6$, or they may be different signals having different lengths of active periods, rather than having different phases, because the maximum instantaneous current (inrush current) in the power source can be reduced so long as the signals rise and fall at different times.

Furthermore, as described in the "Other Variants" section of the first embodiment, the number of time divisions may be two or even four or more, and the number of switching control signal lines may be three times, or more than three times, the number of time divisions, that being two or more. In this case, at least two, preferably all, of the switching control signals have different phases from each other during one unit period (e.g., first section) of time division. This reduces the maximum instantaneous current (inrush current) for both the H-power source and the L-power source.

Furthermore, as in the first or second variant of the first embodiment, the switching control signals may be inputted from both ends or near the center of the switching control signal lines, and the number of input points may be two or more.

<4. Fourth Embodiment>

<4.1 Configuration and Operation of the Liquid Crystal Display Device>

The configuration of the liquid crystal display device 100 according to a fourth embodiment of the present invention is approximately the same as in the second embodiment, except that buffer circuits different in configuration from the buffer circuits 505 shown in FIG. 9 are provided, therefore, the same elements are denoted by the same reference characters, and any descriptions thereof will be omitted. The configuration of the buffer circuit in the present embodiment will be described below with reference to FIG. 13.

<4.2 Configuration and Operation of the Buffer Circuit>

Figure 13:
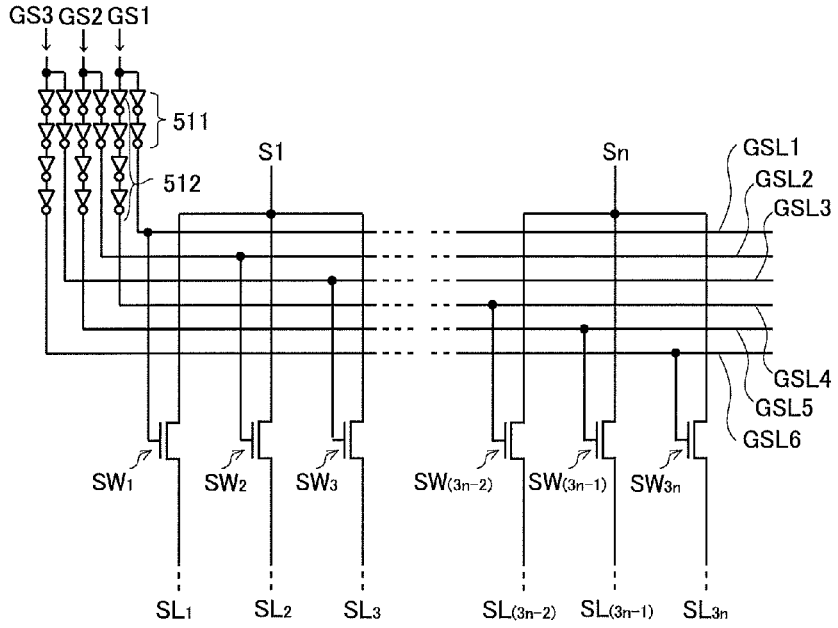
FIG. 13 is a diagram illustrating equivalent circuits of change-over switches in a fourth embodiment of the present invention, along with buffer circuits.

FIG. 13 is a diagram illustrating equivalent circuits of change-over switches in a fourth embodiment, along with buffer circuits. As shown in FIG. 13, switching control signals $GS_1$ to $GS_3$ outputted by the display control circuit 200 are split into two immediately before they are provided to buffer circuits 511 and 512, so that the switching control signal $GS_1$, the switching control signal $GS_2$, and the switching control signal $GS_3$ are respectively provided to switching control signal lines $GSL_1$ and $GSL_4$, switching control signal lines $GSL_2$ and $GSL_5$, and switching control signal lines $GSL_3$ and $GSL_6$ through their corresponding buffer circuits 511 and 512.

Here, the buffer circuits 511 are provided one for each of the switching control signal lines $GSL_1$, $GSL_2$, and $GSL_3$, and the buffer circuits 512 are provided one for each of the switching control signal lines $GSL_4$, $GSL_5$, and $GSL_6$. The buffer circuit 511 is formed by two inverters connected in a series, and the buffer circuit 512 is formed by four inverters connected in a series.

In addition to the same effects as in the second embodiment, e.g., the effect of simplifying the configuration of the display control circuit 200, the above configuration makes it possible to achieve the effect of inhibiting generation of power source noise, as in the third embodiment. Specifically, since the number of inverters connected in the buffer circuit 512 is greater by two than in the buffer circuit 511, the switching control signals outputted to the switching control signal lines $GSL_4$, $GSL_5$, and $GSL_6$ are delayed (have phase lags) by a predetermined time period from the switching control signals outputted to the switching control signal lines $GSL_1$, $GSL_2$, and $GSL_3$ by the buffer circuit 511. Moreover, when this delay time is equal to the delay time in the third embodiment (e.g., the period from time $t_1$ to time $t_2$), the liquid crystal display device is driven with the same timing as the drive timing in the third embodiment shown in FIG. 12. Accordingly, as in the third embodiment, the maximum instantaneous current (inrush current) can be reduced for both the H-power source and the L-power source, so that noise from the H-power source and the L-power source can be suppressed.

<4.3 Effects of the Fourth Embodiment>

As described above, the present embodiment renders it possible to simultaneously achieve similar effects to those achieved by the first through third embodiments. Specifically, the configuration similar to that in the first embodiment makes it possible to reduce waveform rounding of the switching control signals transmitted by the switching control signal lines. As a result, an appropriate turn-on time can be ensured for each switching element, whereby display defects due to insufficient charge in the pixel forming portions can be inhibited or eliminated. Moreover, by providing additional buffer circuits to the configuration of the second embodiment, the same operation as in the third embodiment can be realized, so that malfunction (or undesirable operations or suchlike) of the display device due to power source noise can be inhibited or eliminated using simplified wiring as in the conventional art and a simplified configuration of the display control circuit 200 compared to the first embodiment.

<4.4 Variants of the Fourth Embodiment>

<4.4.1 First Variant>

Figure 14:
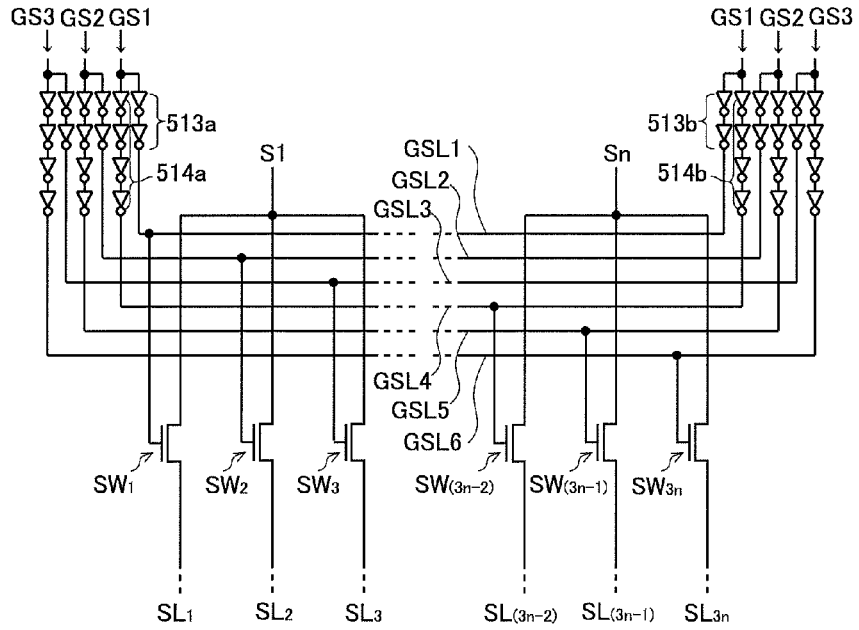
FIG. 14 is a diagram illustrating equivalent circuits of change-over switches in a first variant of the embodiment, along with buffer circuits.

FIG. 14 is a diagram illustrating equivalent circuits of change-over switches in a first variant of the fourth embodiment, along with buffer circuits. As can be appreciated in comparison with FIG. 10, which illustrates the first variant of the second embodiment, the configuration shown in FIG. 14 differs from the first variant of the second embodiment in that additional buffer circuits are provided along with buffer circuits 514*a* and 514*b* provided at both ends of the switching control signal lines $GSL_1$ to $GSL_6$.

This configuration increases the frame area in which the circuits are arranged, but the switching control signals $GS_1$ to $GS_3$ inputted from both ends of the switching control signal lines $GSL_1$ to $GSL_6$ via the buffer circuits 513*a*, 513*b*, 514*a*, and 514*b* have waveform rounding that is maximized at the center of the lines to a degree less than the maximum waveform rounding in the fourth embodiment. Therefore, even in a high-resolution liquid crystal panel with a number of video signal lines, an appropriate turn-on time can be ensured for each switching element, whereby display defects due to insufficient charge in the pixel forming portions can be inhibited or eliminated.

<4.4.2 Second Variant>

Figure 15:
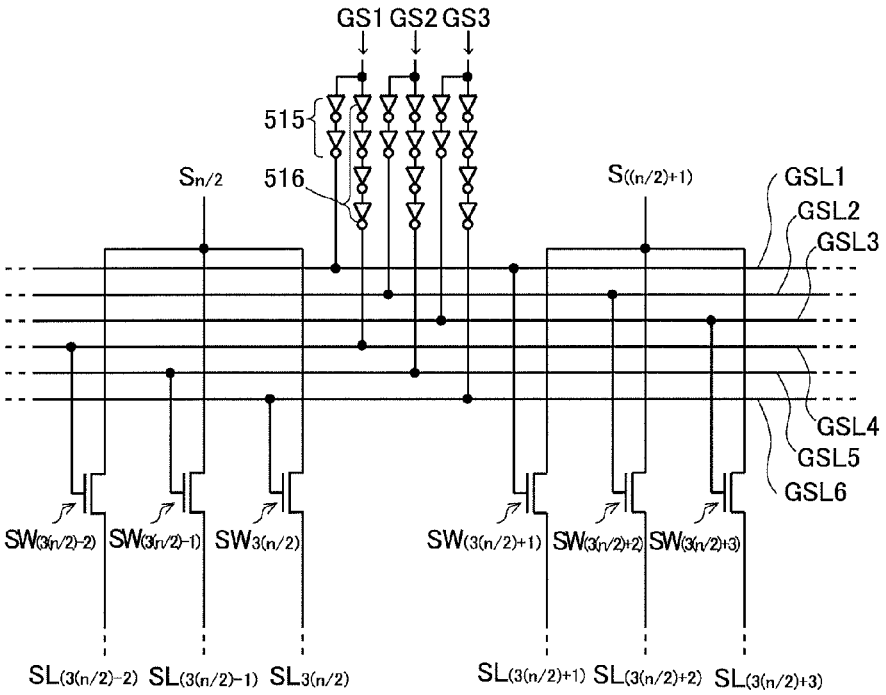
FIG. 15 is a diagram illustrating equivalent circuits of change-over switches in a second variant of the embodiment, along with buffer circuits.

FIG. 15 is a diagram illustrating equivalent circuits of change-over switches in a second variant of the fourth embodiment, along with buffer circuits. As can be appreciated in comparison with FIG. 11, which illustrates the second variant of the second embodiment, the configuration shown in FIG. 15 differs from the second variant of the second embodiment in that additional buffer circuits are provided along with buffer circuits 516 provided at the center of the switching control signal lines $GSL_1$ to $GSL_6$.

This configuration increases the frame area in which the circuits are arranged, but the switching control signals $GS_1$ to $GS_3$ inputted from the center of the switching control signal lines $GSL_1$ to $GSL_6$ via the buffer circuits 515 and 516 have waveform rounding that is maximized at both ends of the lines to a degree less than the maximum waveform rounding in the fourth embodiment. Therefore, even in a high-resolution liquid crystal panel with a number of video signal lines, the number of buffer circuits can be maintained the same as the number of buffer circuits in the fourth embodiment, and an appropriate turn-on time can be ensured for each switching element, whereby display defects due to insufficient charge in the pixel forming portions can be inhibited or eliminated.

<4.4.3 Other Variants>

As described in the "Other Variants" section of the first embodiment, the number of time divisions may be two or even four or more, and the number of switching control signal lines may be three times, or more than three times, the number of time divisions, that being two or more. In this case, at least two, preferably all, of the switching control signals have different phases from each other during one unit period (e.g., first section) of time division. This reduces the maximum instantaneous current (inrush current) for both the H-power source and the L-power source.

Furthermore, as in the second variant also, the switching control signals may be inputted to the switching control signal lines at a position other than near the center thereof, and the number of input points may be two or more. Moreover, there are other conceivable variants similar to those of the third embodiment.

In the fourth embodiment and variants thereof, in place of the buffer circuits additionally provided to delay the switching control signals, well-known delay circuits having the same signal delay function may be additionally provided.

<5. Fifth Embodiment>

<5.1 Configuration and Operation of the Liquid Crystal Display Device>

The liquid crystal display device 100 according to a fifth embodiment of the present invention is configured such that, among the switching control signal lines $GSL_1$ to $GSL_6$ as provided in each of the above embodiments, the switching control signal lines $GSL_4$ to $GSL_6$ are omitted, and only the switching control signal lines $GSL_1$ to $GSL_3$ are provided. Moreover, among the switching elements that are included in two adjacent demultiplexers, two switching elements receive the same switching control signal from their corresponding switching control signal line via one buffer circuit. Other than this feature, approximately the same features and operations as in the first embodiment are employed, therefore, the same elements are denoted by the same reference characters, and any descriptions thereof will be omitted. The buffer circuits provided on the liquid crystal panel 500 will be described below with reference to FIG. 16.

<5.2 Configuration and Operation of the Buffer Circuit>

Figure 16:
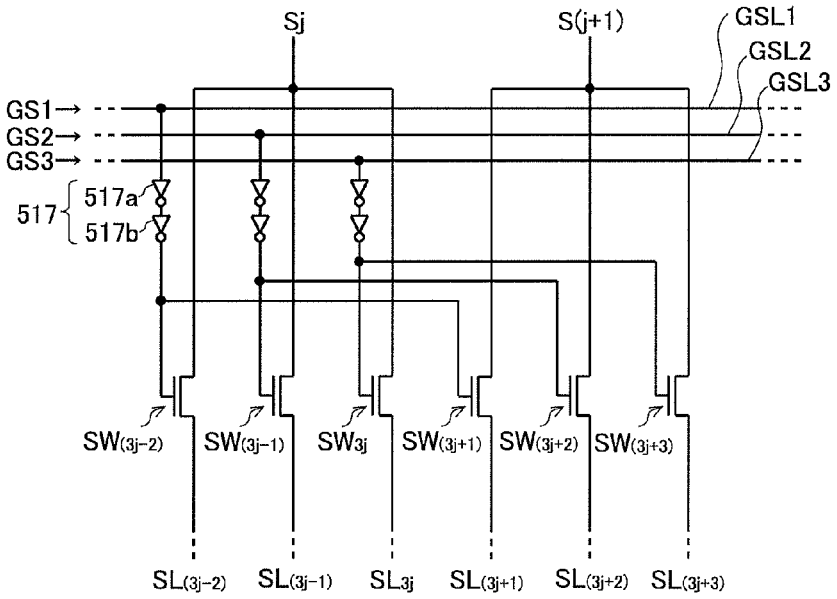
FIG. 16 is a diagram illustrating equivalent circuits of change-over switches in a fifth embodiment of the present invention, along with buffer circuits.

FIG. 16 is a diagram illustrating equivalent circuits of change-over switches in the fifth embodiment, along with buffer circuits. As shown in FIG. 16, switching control signals $GS_1$ to $GS_3$ outputted by the display control circuit 200 are transmitted by the switching control signal lines $GSL_1$ to $GSL_3$ and supplied to buffer circuits 517 provided between the switching control signal lines $GSL_1$ to $GSL_3$ and the switching elements in one of two adjacent demultiplexers (here, the left one in the figure). The buffer circuits 517 receive the switching control signals $GS_1$ to $GS_3$ transmitted by the switching control signal lines $GSL_1$ to $GSL_3$, and provide them to their respectively corresponding pairs of switching elements. For example, the switching control signal $GS_1$ is provided to switching elements $SW_{(3j-2)}$ and $SW_{(3j+1)}$ shown in FIG. 16 via the buffer circuit 517.

Here, the buffer circuit 517 is formed, for example, on a glass substrate by two inverters 517*a* and 517*b* connected in a series between the switching control signal line $GSL_1$ and the switching element $SW_{(3j-2)}$. Here, each switching element included in the demultiplexer has a transistor size required for driving the video signal line SL within a predetermined period of time. Moreover, the inverter 517*b* has the capability of driving two switching elements included in the demultiplexer within a predetermined period of time, and the inverter 517*a* has the capability of driving the inverter 517*b* within a predetermined period of time. As for the loads that are connected to the transistors, the size of the transistor to be included in the demultiplexer is the largest, and the size of the transistor to be included in the inverter 517*a* is the smallest. Therefore, the transistor loads connected to the switching control signal lines $GSL_1$ to $GSL_3$ are small transistor loads provided as the inverters 517*a*, rather than the switches included in the demultiplexer that have a large transistor size as in the conventional art. Accordingly, the load on the switching control signal lines from the switching elements coupled thereto can be reduced, resulting in reduced waveform rounding of the switching control signals transmitted by the switching control signal lines. As a result, an appropriate turn-on time can be ensured for each switching element, whereby display defects due to insufficient charge in the pixel forming portions can be inhibited or eliminated.

<5.3 Effects of the Fifth Embodiment>

As described above, in the display device employing the video-signal-line time-division drive mode of the present embodiment, the number of switching control signal lines for transmitting the switching control signals that are to be provided to switching elements coupled to video signal lines is the same as the number of time divisions (here, three), but the switching control signals are transmitted to their corresponding pairs of switching elements via the buffer circuits 517, so that the load on the switching control signal lines from the switching elements coupled thereto can be reduced, resulting in reduced waveform rounding of the switching control signals transmitted by the switching control signal lines. As a result, an appropriate turn-on time can be ensured for each switching element, whereby display defects due to insufficient charge in the pixel forming portions can be inhibited or eliminated.

<5.4 Variants of the Fifth Embodiment>

<5.4.1 First Variant>

Figure 17:
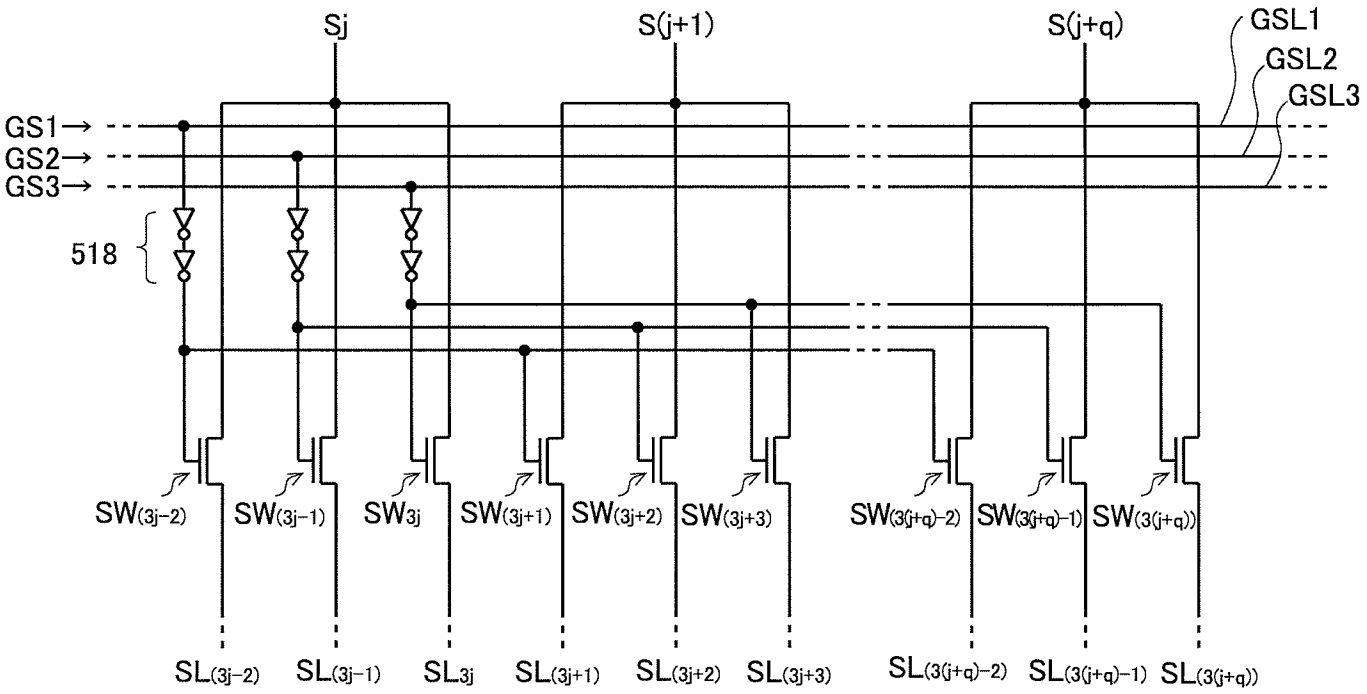
FIG. 17 is a diagram illustrating equivalent circuits of change-over switches in a first variant of the embodiment, along with buffer circuits.

In the above embodiment, the number of switching elements connected to one buffer circuit 517 is two, but it may be three or more, as shown in FIG. 17.

FIG. 17 is a diagram illustrating equivalent circuits of change-over switches in a first variant of the fifth embodiment, along with buffer circuits. As shown in FIG. 17, each buffer circuit 518 is connected to q (where q is an integer of 3 or more) neighboring switching elements. For example, the buffer circuit 518 is coupled at an input to the switching control signal line $GSL_1$ and at an output to switching elements $SW_{(3j-2)}$, $SW_{(3j+1)}$, . . . , and $SW_{(3(j+q)-2)}$. In the case where one buffer circuit is coupled to a number of switching elements in this manner, the drive capability required of the buffer circuit becomes higher, but the load on the control signal line is reduced, so that waveform rounding of the switching control signals transmitted by the switching control signal lines can be reduced. Note that the number of time divisions here is three, but it may be two or even four or more, as described earlier.

<5.4.2 Second Variant>

The number of buffer circuits 517 connected between the control signal line and the switching element in each of the above embodiments is one, and the same is true for the buffer circuit 518 in the first variant of the present embodiment, but the configuration of the fourth embodiment (FIG. 13) may be employed so as to be adapted to the configuration of the present embodiment, so that a different number of buffer circuits are connected to each switching element. This will be described below with reference to FIG. 18.

Figure 18:
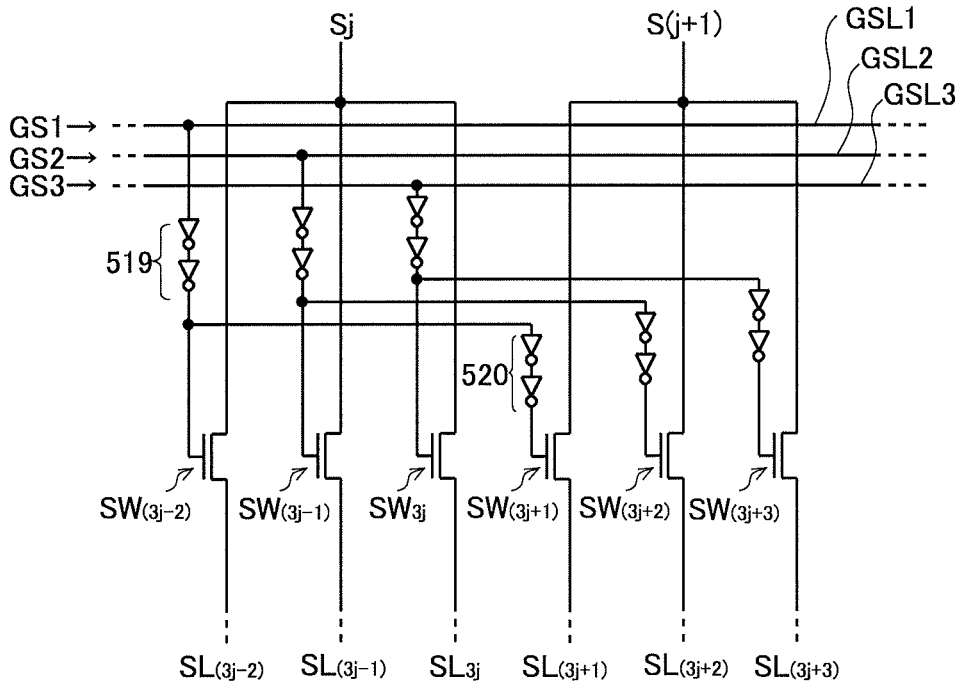
FIG. 18 is a diagram illustrating equivalent circuits of change-over switches in a second variant of the embodiment, along with buffer circuits.

FIG. 18 is a diagram illustrating equivalent circuits of change-over switches in a second variant of the fifth embodiment, along with buffer circuits. As shown in FIG. 18, each buffer circuit 519, similar to the buffer circuit 517 shown in FIG. 16, is provided between the switching control signal line $GSL_1$ and the switching element $SW_{(3j-2)}$, and furthermore, a buffer circuit 520 is provided between (an output of) the buffer circuit 519 and the switching element $SW_{(3j+1)}$. Note that the buffer circuit 519 is formed by two inverters connected in a series, and the buffer circuit 520 is also formed by two inverters connected in a series. The switching element $SW_{(3j+1)}$ is supplied with a switching control signal from the switching control signal line $GSL_1$ via the two buffer circuits 519 and 520.

As can be appreciated with reference to FIG. 18, each of the switching control signals $GS_1$ to $GS_3$ is provided to a switching element in one of the two adjacent demultiplexers (here, the left one in the figure) via one buffer circuit (e.g., the buffer circuit 519), and is also provided to a switching element in the other of the two adjacent demultiplexers (here, the right one in the figure) via two buffer circuits (e.g., the buffer circuits 519 and 520).

Accordingly, by employing such a configuration corresponding to the third or fourth embodiment, it is rendered possible to achieve an effect similar to that achieved by either of the embodiments, i.e., the effect of inhibiting generation of power source noise. Specifically, the switching control signals $GS_1$ to $GS_3$ outputted by the buffer circuits 520 are delayed (have phase lags) by a predetermined time period from the switching control signals $GS_1$ to $GS_3$ outputted by the buffer circuits 519, so that the maximum instantaneous current (inrush current) can be reduced for both the H-power source and the L-power source, as mentioned earlier, thereby suppressing noise from the H-power source and the L-power source. Thus, malfunction (or undesirable operations or suchlike) of the display device due to power source noise can be inhibited or eliminated.

<5.4.3 Other Variants>

In the present embodiment, as described in the "Other Variants" section of the fourth embodiment, the number of time divisions may be two or even four or more, and the number of switching control signal lines may be three times, or more than three times, the number of time divisions, that being two or more. In this case, at least two of the switching control signals have different phases from each other during one unit period (e.g., first section) of time division; preferably, all of the switching control signals have different phases from one another during one unit period, i.e., for each switching control signal line and its corresponding switching element, a different number of buffer circuits are connected therebetween. This reduces the maximum instantaneous current (inrush current) for both the H-power source and the L-power source.

Furthermore, as in the first or second variant of the first embodiment, the switching control signals may be inputted from both ends or near the center of the switching control signal lines, and the number of input points may be two or more.

Furthermore, in the present embodiment and variants thereof, in place of the buffer circuits additionally provided to delay switching control signals (e.g., the buffer circuits 520), well-known delay circuits having the same signal delay function may be additionally provided.

<6. Other Variants of the Embodiments>

In each of the above embodiments, the switching element $SW_i$ has been described as an n-channel TFT, but it may be an analog switch consisting of, for example, an n-channel TFT, a p-channel TFT, and an inverter, in which an input signal to the p-channel TFT is generated by inverting an input signal to the n-channel TFT by the inverter, or it may be another well-known element or circuit that can be used as a switch.

While the above embodiments have been described taking the active-matrix liquid crystal display device as an example, the present invention can also be applied to active-matrix display devices using electro-optic elements other than liquid crystal elements, so long as the video-signal-line time-division drive mode is employed. Note that the term "electro-optic element" herein refers not only to a liquid crystal element but also to any type of elements whose optical properties are changed upon application of electricity, such as LEDs (light-emitting diodes), including organic and inorganic EL elements, FEDs, charge-driven elements, and e-ink (electronic ink).

INDUSTRIAL APPLICABILITY

The present invention is applied to active-matrix display devices, and is suitable for display devices employing the video-signal-line time-division drive mode, in which a driver circuit sequentially outputs video signals via switching elements.

DESCRIPTION OF THE REFERENCE CHARACTERS

10 TFT (thin-film transistor)
25 switching control circuit
100 liquid crystal display device
200 display control circuit
300 video signal line driver circuit
400 scanning signal line driver circuit
500 liquid crystal panel
501 demultiplexer
600 demultiplexer area
700 display area
SCK source clock signal
SSP source start pulse signal
GCK gate clock signal
GSP gate start pulse signal
Da digital image signal
$GS_1$ to $GS_6$ switching control signal
$TS_1$, $TS_2$ output terminal
$G_k$ scanning signal (k=1, 2, 3, . . . )
$S_j$ video signal (j=1, 2, 3, . . . )
SL video signal line
Ls video signal line (column-electrode)
Lg scanning signal line (row-electrode)
Px pixel forming portion (pixel)
$GSL_1$ to $GSL_6$ switching control signal line
$SW_i$ switching element (i=1, 2, 3, . . . )

The invention claimed is:

1. An active-matrix display device, comprising:

a plurality of pixel forming portions for forming an image to be displayed;

a plurality of video signal lines for transmitting video signals representing the image to be displayed;

a plurality of scanning signal lines crossing the video signal lines;

a plurality of switching elements arranged so as to respectively correspond to the video signal lines;

a plurality of control signal lines for transmitting control signals to control the plurality of switching elements, the pixel forming portions being arranged in a matrix in correspondence with respective intersections of the video signal lines and the scanning signal lines;

a scanning signal line driver circuit for selectively driving the scanning signal lines;

a video-signal-line time-division drive portion for driving the video signal lines by sequentially applying image signals inputted to represent the image to be displayed, to the video signal lines via the switching elements in a time-division manner within a predetermined period; and a display control circuit for providing the control signals to the switching elements via the control signal lines, for controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive portion includes:

a video signal output circuit including a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, and the control signal lines are divided into sets whose number is equivalent to the number of video signal lines in the video signal line group corresponding to any one of the plurality of first output terminals, each set consisting of a plurality of control signal lines for transmitting a plurality of control signals to control switching elements that are to be turned on within a unit period of the time division.

2. The display device according to claim 1, further comprising buffer circuits respectively coupled to the control signal lines, wherein, for each set of control signal lines, the display control circuit has one second output terminal for outputting the control signal, and the buffer circuits receive the control signals outputted from the second output terminals corresponding to the sets of control signal lines, and provide the control signals to the control signal lines coupled thereto.

3. The display device according to claim 2, wherein for each set of control signal lines, the number of buffer circuits provided between the control signal line coupled thereto and the second output terminal corresponding to that set of control signal lines varies among the same set of control signal lines so that control signals transmitted by the coupled control signal lines have different phases among the same set of control signal lines.

4. The display device according to claim 2, wherein, the display control circuit applies the control signals to the control signal lines only from one end, and the buffer circuits are coupled to that end.

5. The display device according to claim 2, wherein, the display control circuit applies the control signals to the control signal lines from both ends, and the buffer circuits are coupled to either of the ends.

6. The display device according to claim 2, wherein, the display control circuit applies the control signals to the control signal lines from an input point other than both ends, and the buffer circuits are coupled to the input point.

7. The display device according to claim 1, further comprising a plurality of buffer circuits respectively coupled to the control signal lines, wherein, for each set of switching elements to be turned on within a unit period of the time division, the buffer circuits receive control signals from the control signal lines coupled thereto, and provide the control signals to switching elements respectively coupled to different first output terminals among the same set of switching elements.

8. The display device according to claim 1, wherein the first output terminals of the video signal output circuit respectively correspond to video signal line groups into which the video signal lines are divided, each group consisting of adjacent video signal lines respectively coupled to a plurality of pixel forming portions that respectively display predetermined primary colors.

9. The display device according to claim 1, wherein, for each set of control signal lines, the display control circuit outputs control signals that rise and fall at different times from each other during the unit period.

10. The display device according to claim 1, further comprising delay circuits, each being coupled to one of the control signal lines, wherein, the delay circuits are provided one or more for each set of control signal lines such that control signals transmitted by the set of control signal lines have different phases from each other during the unit period.

11. The display device according to claim 1, wherein the display control circuit applies the control signals to the control signal lines only from one end.

12. The display device according to claim 1, wherein the display control circuit applies the control signals to the control signal lines from both ends.

13. The display device according to claim 1, wherein the display control circuit applies the control signals to the control signal lines from an input point other than both ends.

14. The display device according to claim 1, wherein the control signal lines in each set are connected to different first output terminals.

15. An active-matrix display device with a plurality of pixel forming portions for forming an image to be displayed, a plurality of video signal lines for transmitting video signals representing the image to be displayed, a plurality of scanning signal lines crossing the video signal lines, and a plurality of control signal lines for transmitting control signals to control a plurality of switching elements provided so as to respectively correspond to the video signal lines, the pixel forming portions being arranged in a matrix in correspondence with respective intersections of the video signal lines and the scanning signal lines, the device comprising:

a scanning signal line driver circuit for selectively driving the scanning signal lines;

a video-signal-line time-division drive portion for driving the video signal lines by sequentially applying image signal inputted to represent the image to be displayed, to the video signal lines via the switching elements in a time-division manner within a predetermined period;

a plurality of buffer circuits respectively coupled to the control signal lines; and a display control circuit for providing the control signals to the switching elements via the buffer circuits coupled to the control signal lines, thereby controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive portion includes:

a video signal output circuit with a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, the control signal lines are provided in a number equivalent to the number of time divisions, and for each set of switching elements to be turned on within a unit period of the time division, the buffer circuits receive control signal transmitted by the control signal line coupled thereto, and respectively output the control signals to control switching elements coupled within the same set.

16. The display device according to claim 15, wherein for each set of switching elements, the number of buffer circuits provided between the control signal line coupled thereto and the coupled switching elements varies among the same set of switching elements so that control signals transmitted to the coupled switching elements have different phases among the same set of switching elements during the unit period.

17. A method for driving an active-matrix display device, the active-matrix display device comprising:

a plurality of pixel forming portions for forming an image to be displayed, a plurality of video signal lines for transmitting video signals representing the image to be displayed, a plurality of scanning signal lines crossing the video signal lines, a plurality of switching elements arranged so as to respectively correspond to the video signal lines, and a plurality of control signal lines for transmitting control signals to control the plurality of switching elements, the pixel forming portions being arranged in a matrix in correspondence with respective intersections of the video signal lines and the scanning signal lines, the method comprising:

a scanning signal line drive step of selectively driving the scanning signal lines;

a video-signal-line time-division drive step of driving the video signal lines by sequentially applying image signals inputted to represent the image to be displayed, to the video signal lines via the switching elements in a time-division manner within a predetermined period; and a display control step of providing the control signals to the switching elements via the control signal lines, for controlling the switching elements so as to be kept on for a period required for providing video signals to pixel forming portions coupled to the scanning signal lines selected by the scanning signal line driver circuit, the video signals being transmitted by video signal lines corresponding to the pixel forming portions, wherein, the video-signal-line time-division drive step includes:

an output step performed by a video signal output circuit including a plurality of first output terminals respectively corresponding to a plurality of video signal line groups into which the video signal lines are divided, the video signal output circuit outputting video signals from the first output terminals in the time-division manner so as to be transmitted by the video signal line groups corresponding to the first output terminals; and a switching step performed by a demultiplexer having the switching elements that connect each of the first output terminals of the video signal output circuit to one of the video signal lines in the video signal line group corresponding to that first output terminal and switch the video signal line to be connected to the first output terminal among the video signal line group corresponding to the first output terminal in accordance with the time-division manner, and the control signal lines are divided into sets whose number is equivalent to the number of video signal lines in the video signal line group corresponding to any one of the plurality of first output terminals, each set consisting of a plurality of control signal lines for transmitting a plurality of control signals to control switching elements that are to be turned on within a unit period of the time division.

18. The method according to claim 17, wherein the control signal lines in each set are connected to different first output terminals.

* * * * *